US008776740B2

(12) United States Patent
Meldolesi et al.

(10) Patent No.: US 8,776,740 B2
(45) Date of Patent: Jul. 15, 2014

(54) LOST-MOTION VARIABLE VALVE ACTUATION SYSTEM WITH CAM PHASER

(75) Inventors: Riccardo Meldolesi, West Sussex (GB); John Schwoerer, Storrs, CT (US); Joseph Paturzo, Avon, CT (US)

(73) Assignee: Scuderi Group, LLC, West Springfield, MA (US)

( * ) Notice: Subject to any disclaimer, the term of this patent is extended or adjusted under 35 U.S.C. 154(b) by 80 days.

(21) Appl. No.: 13/359,521

(22) Filed: Jan. 27, 2012

(65) Prior Publication Data

US 2012/0192818 A1 Aug. 2, 2012

Related U.S. Application Data

(60) Provisional application No. 61/436,735, filed on Jan. 27, 2011.

(51) Int. Cl.
*F01L 1/34* (2006.01)

(52) U.S. Cl.
USPC ..... 123/90.16

(58) Field of Classification Search
USPC ..... 123/90.15–90.17
See application file for complete search history.

(56) References Cited

U.S. PATENT DOCUMENTS

| | | | |
|---|---|---|---|
| 1,531,909 | A | 3/1925 | Engemann |
| 1,936,653 | A | 11/1933 | Almen |
| 2,109,809 | A | 3/1938 | Van Ranst |
| 2,218,575 | A | 10/1940 | Griswold |
| 2,394,354 | A | 2/1946 | Barr |
| 2,772,667 | A | 12/1956 | Nallinger |
| 3,209,737 | A | 10/1965 | Isao |
| 3,774,581 | A | 11/1973 | Lundy |
| 3,786,792 | A | 1/1974 | Pelizzoni et al. |
| 3,808,818 | A | 5/1974 | Cataldo |
| 3,880,126 | A | 4/1975 | Thurston et al. |
| 3,908,701 | A | 9/1975 | Dawawala |
| 3,935,765 | A | 2/1976 | Peltier et al. |
| 3,938,483 | A | 2/1976 | Firey |
| 3,949,964 | A | 4/1976 | Freeman |

(Continued)

FOREIGN PATENT DOCUMENTS

| | | | |
|---|---|---|---|
| DE | 10115967 | A1 | 10/2002 |
| GB | 2250801 | A | 6/1992 |

(Continued)

OTHER PUBLICATIONS

Delphi Cam Phasers (website—NPL) 2010.

(Continued)

*Primary Examiner* — Thomas Denion
*Assistant Examiner* — Steven D Shipe
(74) *Attorney, Agent, or Firm* — Nutter McClennen & Fish LLP; John J. Penny, Jr.; Michael P. Visconti, III

(57) ABSTRACT

Devices and related methods are disclosed that generally involve variable actuation of engine valves. In one embodiment, a valve train for a split-cycle internal combustion engine or an air hybrid split-cycle engine is provided that includes a cam phaser, a dwell cam, an adjustable mechanical element for performing a variable valve actuation function, and/or a valve seating control device. The devices and methods disclosed herein also have application in conventional internal combustion engines and can actuate inwardly-opening and/or outwardly-opening valves.

21 Claims, 23 Drawing Sheets

(56) References Cited

U.S. PATENT DOCUMENTS

| | | | | |
|---|---|---|---|---|
| 4,133,172 | A | 1/1979 | Cataldo | |
| 4,224,798 | A | 9/1980 | Brinkerhoff | |
| 4,418,657 | A | 12/1983 | Wishart | |
| 4,606,314 | A | 8/1986 | Yamazaki | |
| 4,825,717 | A | 5/1989 | Mills | |
| 4,860,716 | A | 8/1989 | Deutschmann | |
| 4,934,652 | A | 6/1990 | Golden | |
| 5,018,487 | A | 5/1991 | Shinkai | |
| 5,080,054 | A | 1/1992 | Nakamura | |
| 5,101,776 | A | 4/1992 | Ma | |
| 5,113,813 | A * | 5/1992 | Rosa | 123/90.16 |
| 5,193,495 | A | 3/1993 | Wood, III | |
| 5,213,072 | A | 5/1993 | Dohring | |
| 5,402,756 | A | 4/1995 | Bohme et al. | |
| 5,445,119 | A | 8/1995 | Regueiro | |
| 5,555,861 | A | 9/1996 | Mayr et al. | |
| 5,664,531 | A | 9/1997 | Kim | |
| 5,690,066 | A | 11/1997 | Hampton et al. | |
| 5,713,316 | A | 2/1998 | Sturman | |
| 5,964,087 | A | 10/1999 | Tort-Oropeza | |
| 5,988,124 | A | 11/1999 | Duesmann | |
| 6,085,705 | A | 7/2000 | Vorih | |
| 6,152,714 | A | 11/2000 | Mitsuya et al. | |
| 6,192,841 | B1 | 2/2001 | Vorih et al. | |
| 6,230,472 | B1 | 5/2001 | Stahlecker | |
| 6,230,742 | B1 | 5/2001 | Bircann | |
| 6,257,183 | B1 | 7/2001 | Vorih et al. | |
| 6,267,098 | B1 | 7/2001 | Vanderpoel | |
| 6,273,057 | B1 | 8/2001 | Schwoerer et al. | |
| 6,302,370 | B1 | 10/2001 | Schwoerer et al. | |
| 6,332,917 | B1 | 12/2001 | Schollkopf | |
| 6,397,579 | B1 | 6/2002 | Negre | |
| 6,412,457 | B1 | 7/2002 | Vorih et al. | |
| 6,474,277 | B1 | 11/2002 | Vanderpoel et al. | |
| 6,510,824 | B2 | 1/2003 | Vorih et al. | |
| 6,543,225 | B2 | 4/2003 | Scuderi | |
| 6,584,885 | B2 | 7/2003 | Lou | |
| 6,609,371 | B2 | 8/2003 | Scuderi | |
| 6,619,873 | B2 | 9/2003 | Parker | |
| 6,647,954 | B2 | 11/2003 | Yang et al. | |
| 6,655,327 | B1 | 12/2003 | Hedman | |
| 6,694,933 | B1 | 2/2004 | Lester | |
| 6,789,514 | B2 | 9/2004 | Suh et al. | |
| 6,874,453 | B2 | 4/2005 | Coney et al. | |
| 6,883,775 | B2 | 4/2005 | Coney et al. | |
| 6,886,511 | B1 | 5/2005 | Tong et al. | |
| 6,952,923 | B2 | 10/2005 | Branyon et al. | |
| 7,077,083 | B2 | 7/2006 | Dingle et al. | |
| 7,140,332 | B2 | 11/2006 | Klein et al. | |
| 7,156,062 | B2 | 1/2007 | Vanderpoel | |
| 7,171,930 | B2 | 2/2007 | Keel | |
| 7,314,027 | B2 | 1/2008 | Murata | |
| 7,353,786 | B2 | 4/2008 | Scuderi et al. | |
| 7,430,997 | B2 * | 10/2008 | Muraji et al. | 123/90.16 |
| 7,481,190 | B2 | 1/2009 | Scuderi | |
| 7,513,224 | B2 | 4/2009 | Heaton | |
| 7,536,984 | B2 | 5/2009 | Lou | |
| 7,603,970 | B2 | 10/2009 | Scuderi et al. | |
| 7,628,126 | B2 | 12/2009 | Scuderi | |
| 7,637,234 | B2 | 12/2009 | Tussing et al. | |
| 7,690,337 | B2 | 4/2010 | Pirault et al. | |
| 7,810,459 | B2 | 10/2010 | Branyon et al. | |
| 7,823,547 | B2 | 11/2010 | Forner, Sr. et al. | |
| 7,963,259 | B2 | 6/2011 | Meldolesi et al. | |
| 2002/0152976 | A1 * | 10/2002 | Nguyen | 123/90.16 |
| 2002/0185091 | A1 | 12/2002 | Vorih et al. | |
| 2003/0192496 | A1 * | 10/2003 | Walters | 123/90.18 |
| 2003/0221663 | A1 | 12/2003 | Vanderpoel et al. | |
| 2004/0065308 | A1 * | 4/2004 | Bryant | 123/562 |
| 2005/0022768 | A1 | 2/2005 | Tores et al. | |
| 2005/0076868 | A1 | 4/2005 | Mott et al. | |
| 2005/0132987 | A1 | 6/2005 | Chang | |
| 2005/0268609 | A1 | 12/2005 | Branyon et al. | |
| 2006/0011154 | A1 | 1/2006 | Scuderi et al. | |
| 2006/0096560 | A1 * | 5/2006 | Afjeh et al. | 123/90.11 |
| 2006/0273271 | A1 | 12/2006 | Yang et al. | |
| 2007/0101958 | A1 | 5/2007 | Seitz | |
| 2007/0157894 | A1 | 7/2007 | Scuderi et al. | |
| 2007/0204818 | A1 | 9/2007 | Dingle | |
| 2007/0272180 | A1 | 11/2007 | Lou | |
| 2008/0054205 | A1 | 3/2008 | Lou | |
| 2008/0078345 | A1 | 4/2008 | Knauf et al. | |
| 2008/0105225 | A1 | 5/2008 | Scuderi et al. | |
| 2008/0196683 | A1 | 8/2008 | Hayman et al. | |
| 2008/0202454 | A1 | 8/2008 | Pirault | |
| 2008/0202459 | A1 * | 8/2008 | Tanabe et al. | 123/90.16 |
| 2008/0251041 | A1 | 10/2008 | Lou | |
| 2009/0038596 | A1 | 2/2009 | Pirault et al. | |
| 2009/0038598 | A1 | 2/2009 | Phillips | |
| 2009/0044778 | A1 | 2/2009 | Scuderi et al. | |
| 2009/0107433 | A1 * | 4/2009 | Tanaka | 123/90.17 |
| 2009/0133648 | A1 | 5/2009 | Lou | |
| 2009/0205598 | A1 | 8/2009 | Takahashi et al. | |
| 2009/0266347 | A1 | 10/2009 | Scuderi et al. | |
| 2009/0276992 | A1 | 11/2009 | Maeda et al. | |
| 2010/0095918 | A1 * | 4/2010 | Cecur | 123/90.16 |
| 2010/0116231 | A1 * | 5/2010 | Toda et al. | 123/90.17 |
| 2010/0126442 | A1 | 5/2010 | Lou | |
| 2010/0132644 | A1 | 6/2010 | Methley et al. | |
| 2010/0161202 | A1 * | 6/2010 | Ide et al. | 701/110 |
| 2010/0180847 | A1 | 7/2010 | Meldolesi et al. | |
| 2010/0180848 | A1 | 7/2010 | Meldolesi et al. | |
| 2010/0180875 | A1 | 7/2010 | Meldolesi et al. | |
| 2010/0186693 | A1 * | 7/2010 | Ezaki | 123/90.16 |
| 2010/0263646 | A1 | 10/2010 | Giannini et al. | |
| 2010/0274466 | A1 * | 10/2010 | Takamiya | 701/103 |
| 2010/0282225 | A1 | 11/2010 | Gilbert et al. | |
| 2010/0300385 | A1 | 12/2010 | Durrett et al. | |
| 2011/0036316 | A1 * | 2/2011 | de Ojeda et al. | 123/90.16 |
| 2011/0220081 | A1 | 9/2011 | Meldolesi et al. | |
| 2012/0192817 | A1 | 8/2012 | Meldolesi et al. | |
| 2012/0192840 | A1 | 8/2012 | Meldolesi et al. | |
| 2012/0192841 | A1 | 8/2012 | Meldolesi et al. | |

FOREIGN PATENT DOCUMENTS

| | | | |
|---|---|---|---|
| GB | 2340881 | A | 3/2000 |
| JP | 40-10860 | A | 1/1992 |
| JP | 10-274105 | A | 10/1998 |
| JP | 2004-293695 | A | 10/2004 |
| WO | 2006094213 | A1 | 9/2006 |

OTHER PUBLICATIONS

Hydraulic Valve Lash Adjustment Elements, INA p. 4-11. 1996.

Hydraulics Theory and Applications, Bosch, ISBN 3-9805925-3-7, 1998.

Kolbenschmidt Pierburg Group, "Exhaust Gas Recirculation," Product Brochure, Pierburg GmbH Neuss, 2007.

Piston Pump: http://www.boschrexroth.com/country_units/america/canada/en/10_products/technology_areas/compu-spread/technical_documents/a10vo_piston_pump/a10vo_pistonpump_manual.pdf (Downloaded Oct. 25, 2011).

Technical Note, A Prototype Spool Valve for Use in Hyrdaulically Powered Arm Prosthesis, http://www.springerlink.com/content/a28v67u483676r8k/ (cover page only) Med Biol Eng. 1972;10:796-7. Last Accessed May 10, 2012.

The Illustrated Catalogue of Spares, Seventh Edition, Sports & Vintage Motors (Shrewsbury) Limited. 1990.

Smith, Tuning and Maintenance of M.G.s, A.M.I.Mech.E., 1938.

Urata, et al. (Honda), A Study of Vehicle Equipped with Non-Throttling S.I. Engine with Early Intake Valve Closing Mechanism, SAE paper 930820 (1993).

International Search Report and Written Opinion for Application No. PCT/US2012/022834 dated May 11, 2012. (9 pages).

International Search Report and Written Opinion mailed May 21, 2012 for Application No. PCT/US2012/022836 (7 Pages).

International Search Report and Written Opinion for Application No. PCT/US2012/022839 dated May 11, 2012. (9 pages).

International Search Report and Written Opinion for Application. PCT/US2012/022830 dated Aug. 31, 2012 (13 pages).

* cited by examiner

LOST-MOTION VARIABLE VALVE ACTUATION SYSTEM WITH CAM PHASER

CROSS-REFERENCE TO RELATED APPLICATIONS

This application claims the benefit of priority of U.S. Provisional Patent Application No. 61/436,735, filed on Jan. 27, 2011, the entire contents of which are incorporated herein by reference.

FIELD

The present invention relates to valve actuation systems. More particularly, the invention relates to a split-cycle internal combustion engine having a lost-motion variable valve actuation system.

BACKGROUND

Internal combustion engines generally include one or more valves for controlling the flow of air and fuel through the engine. These valves are usually actuated by a mechanical cam. For example, a rotating shaft having a teardrop shaped cam lobe can be configured to impart motion to the valve, either directly or via one or more intermediate elements. As the shaft rotates, the eccentric portion of the cam lobe imparts a linear motion to the valve over a range of the shaft's rotation.

It can be desirable to alter the valve lift, opening rate, opening timing, closing timing, closing rate, and various other valve parameters to achieve optimum engine efficiency for a variety of operating speeds, loads, temperatures, etc. In addition, in an air hybrid engine in which kinetic energy generated from a vehicle's momentum is recycled using air as the medium, certain hybrid operating modes require that one or more of the engine valves stay open longer or shorter than in other operating modes, and longer or shorter than in a non-hybrid, traditional combustion operating mode.

"Lost-motion" systems have been developed to permit a valve to close earlier than what is called for by the cam. Lost-motion systems generally include a lost-motion valve train element that can be selectively actuated to operatively disconnect a cam from a valve during a portion of the cam's rotation. The motion that would have otherwise been imparted to the valve (had the valve not been operatively disconnected) is thus lost.

Existing lost-motion systems, however, suffer from many shortcomings. For example, the moving components of existing systems are either too heavy or lack the requisite stiffness to be used in high speed and high pressure applications.

Accordingly, there is a need for improved methods and devices for varying the opening and closing parameters of an engine valve.

For purposes of clarity, the term "conventional engine" as used in the present application refers to an internal combustion engine wherein all four strokes of the well-known Otto cycle (the intake, compression, expansion and exhaust strokes) are contained in each piston/cylinder combination of the engine.

Each stroke requires approximately one half revolution of the crankshaft (180 degrees crank angle (CA)), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine generally comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween.

FIG. 1 illustrates a prior art split-cycle, non-hybrid engine. The split-cycle engine 100 replaces two adjacent cylinders of a conventional engine with a combination of one compression cylinder 102 and one expansion cylinder 104. The compression cylinder 102 and the expansion cylinder 104 are formed in an engine block in which a crankshaft 106 is rotatably mounted. The crankshaft 106 includes axially displaced and angularly offset first and second crank throws 126, 128, having a phase angle therebetween. The first crank throw 126 is pivotally joined by a first connecting rod 138 to a compression piston 110, and the second crank throw 128 is pivotally joined by a second connecting rod 140 to an expansion piston 120 to reciprocate the pistons 110, 120 in their respective cylinders 102, 104 in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The four strokes of the Otto cycle are thus "split" over the two cylinders 102, 104 such that the compression cylinder 102 contains the intake and compression strokes and the expansion cylinder 104 contains the expansion and exhaust strokes. The Otto cycle is therefore completed in these two cylinders 102, 104 once per crankshaft 106 revolution (360 degrees CA).

During the intake stroke, intake air is drawn into the compression cylinder 102 through an inwardly-opening (opening inward into the cylinder and toward the piston) poppet intake valve 108. During the compression stroke, the compression piston 110 pressurizes the air charge and drives the air charge through a crossover passage 112, which acts as the intake passage for the expansion cylinder 104. The engine 100 can have one or more crossover passages 112.

The volumetric (or geometric) compression ratio of the compression cylinder 102 of the split-cycle engine 100 (and for split-cycle engines in general) is herein referred to as the "compression ratio" of the split-cycle engine. The volumetric (or geometric) compression ratio of the expansion cylinder 104 of the engine 100 (and for split-cycle engines in general) is herein referred to as the "expansion ratio" of the split-cycle engine. The volumetric compression ratio of a cylinder is well known in the art as the ratio of the enclosed (or trapped) volume in the cylinder (including all recesses and open ports) when a piston reciprocating therein is at its bottom dead center (BDC) position to the enclosed volume (i.e., clearance volume) in the cylinder when said piston is at its top dead center (TDC) position. Specifically for split-cycle engines as defined herein, the compression ratio of a compression cylinder is determined when the XovrC valve is closed. Also specifically for split-cycle engines as defined herein, the expansion ratio of an expansion cylinder is determined when the XovrE valve is closed.

Due to very high volumetric compression ratios (e.g., 20 to 1, 30 to 1, 40 to 1, or greater) within the compression cylinder 102, an outwardly-opening (opening outwardly away from the cylinder and piston) poppet crossover compression (XovrC) valve 114 at the crossover passage inlet is used to control flow from the compression cylinder 102 into the crossover passage 112. Due to very high volumetric compression ratios (e.g., 20 to 1, 30 to 1, 40 to 1, or greater) within the expansion cylinder 104, an outwardly-opening poppet crossover expansion (XovrE) valve 116 at the outlet of the crossover passage 112 controls flow from the crossover passage 112 into the expansion cylinder 104. The actuation rates and phasing of the XovrC and XovrE valves 114, 116 are timed to maintain pressure in the crossover passage 112 at a high minimum pressure (typically 20 bar or higher at full load) during all four strokes of the Otto cycle.

At least one fuel injector 118 injects fuel into the pressurized air at the exit end of the crossover passage 112 in coordination with the XovrE valve 116 opening. Alternatively, or in addition, fuel can be injected directly into the expansion cylinder 104. The fuel-air charge fully enters the expansion cylinder 104 shortly after the expansion piston 120 reaches its top dead center (TDC) position. As the piston 120 begins its descent from its TDC position, and while the XovrE valve 116 is still open, one or more spark plugs 122 are fired to initiate combustion (typically between 10 to 20 degrees CA after TDC of the expansion piston 120). Combustion can be initiated while the expansion piston is between 1 and 30 degrees CA past its top dead center (TDC) position. More preferably, combustion can be initiated while the expansion piston is between 5 and 25 degrees CA past its TDC position. Most preferably, combustion can be initiated while the expansion piston is between 10 and 20 degrees CA past its TDC position. Additionally, combustion can be initiated through other ignition devices and/or methods, such as with glow plugs, microwave ignition devices, or through compression ignition methods.

The XovrE valve 116 is closed before the resulting combustion event enters the crossover passage 112. The combustion event drives the expansion piston 120 downward in a power stroke. Exhaust gases are pumped out of the expansion cylinder 104 through an inwardly-opening poppet exhaust valve 124 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 126, 128 for the compression cylinder 102 and expansion cylinder 104, respectively, have different radii and are phased apart from one another with TDC of the expansion piston 120 occurring prior to TDC of the compression piston 110. This independence enables the split-cycle engine to potentially achieve higher efficiency levels and greater torques than typical four-stroke engines.

The geometric independence of engine parameters in the split-cycle engine 100 is also one of the main reasons why pressure can be maintained in the crossover passage 112 as discussed earlier. Specifically, the expansion piston 120 reaches its top dead center position prior to the compression piston 110 reaching its top dead center position by a discrete phase angle (typically between 10 and 30 crank angle degrees). This phase angle, together with proper timing of the XovrC valve 114 and the XovrE valve 116, enables the split-cycle engine 100 to maintain pressure in the crossover passage 112 at a high minimum pressure (typically 20 bar absolute or higher during full load operation) during all four strokes of its pressure/volume cycle. That is, the split-cycle engine 100 can be operable to time the XovrC valve 114 and the XovrE valve 116 such that the XovrC and XovrE valves 114, 116 are both open for a substantial period of time (or period of crankshaft rotation) during which the expansion piston 120 descends from its TDC position towards its BDC position and the compression piston 110 simultaneously ascends from its BDC position towards its TDC position. During the period of time (or crankshaft rotation) that the crossover valves 114, 116 are both open, a substantially equal mass of gas is transferred (1) from the compression cylinder 102 into the crossover passage 112 and (2) from the crossover passage 112 to the expansion cylinder 104. Accordingly, during this period, the pressure in the crossover passage is prevented from dropping below a predetermined minimum pressure (typically 20, 30, or 40 bar absolute during full load operation). Moreover, during a substantial portion of the intake and exhaust strokes (typically 90% of the entire intake and exhaust strokes or greater), the XovrC valve 114 and XovrE valve 116 are both closed to maintain the mass of trapped gas in the crossover passage 112 at a substantially constant level. As a result, the pressure in the crossover passage 112 is maintained at a predetermined minimum pressure during all four strokes of the engine's pressure/volume cycle.

For purposes herein, the method of opening the XovrC 114 and XovrE 116 valves while the expansion piston 120 is descending from TDC and the compression piston 110 is ascending toward TDC in order to simultaneously transfer a substantially equal mass of gas into and out of the crossover passage 112 is referred to herein as the "push-pull" method of gas transfer. It is the push-pull method that enables the pressure in the crossover passage 112 of the engine 100 to be maintained at typically 20 bar or higher during all four strokes of the engine's cycle when the engine is operating at full load.

The crossover valves 114, 116 are actuated by a valve train that includes one or more cams (not shown). In general, a cam-driven mechanism includes a camshaft mechanically linked to the crankshaft. One or more cams are mounted to the camshaft, each having a contoured surface that controls the valve lift profile of the valve event (i.e., the event that occurs during a valve actuation). The XovrC valve 114 and the XovrE valve 116 can each have its own respective cam and/or its own respective camshaft. As the XovrC and XovrE cams rotate, eccentric portions thereof impart motion to a rocker arm, which in turn imparts motion to the valve, thereby lifting (opening) the valve off of its valve seat. As the cam continues to rotate, the eccentric portion passes the rocker arm and the valve is allowed to close.

For purposes herein, a valve event (or valve opening event) is defined as the valve lift from its initial opening off of its valve seat to its closing back onto its valve seat versus rotation of the crankshaft during which the valve lift occurs. Also, for purposes herein, the valve event rate (i.e., the valve actuation rate) is the duration in time required for the valve event to occur within a given engine cycle. It is important to note that a valve event is generally only a fraction of the total duration of an engine operating cycle (e.g., 720 degrees CA for a conventional engine cycle and 360 degrees CA for a split-cycle engine).

Further detail on split-cycle engines can be found in U.S. Pat. No. 6,543,225 entitled Split Four Stroke Cycle Internal Combustion Engine and issued on Apr. 8, 2003; U.S. Pat. No.

6,609,371 entitled Split Four Stroke Engine and issued on Aug. 26, 2003; and U.S. Pat. No. 6,952,923 entitled Split-Cycle Four-Stroke Engine and issued on Oct. 11, 2005, each of which is incorporated by reference herein in its entirety.

FIG. 2 illustrates a prior art air hybrid engine in which a split-cycle engine 200 similar to that shown in FIG. 1 is modified to include an air hybrid system. The split-cycle air hybrid engine 200 combines a split-cycle engine with an air reservoir and various controls. This combination enables the engine to store energy in the form of compressed air in the air reservoir. The compressed air in the air reservoir is later used in the expansion cylinder to power the crankshaft.

In general, a split-cycle air hybrid engine as referred to herein comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft;

a crossover passage (port) interconnecting the compression and expansion cylinders, the crossover passage including at least a crossover expansion (XovrE) valve disposed therein, but more preferably including a crossover compression (XovrC) valve and a crossover expansion (XovrE) valve defining a pressure chamber therebetween; and an air reservoir operatively connected to the crossover passage and selectively operable to store compressed air from the compression cylinder and to deliver compressed air to the expansion cylinder.

Like the engine 100 shown in FIG. 1, the engine 200 includes an engine block 201 having a compression cylinder 202 and an adjacent expansion cylinder 204 extending therethrough. A crankshaft 206 is journaled in the block 201 for rotation about a crankshaft axis. Upper ends of the cylinders 202, 204 are closed by a cylinder head 230.

The first and second cylinders 202, 204 define internal bearing surfaces in which are received for reciprocation a compression piston 210 and a power (or "expansion") piston 220, respectively. The cylinder head 230, the compression piston 210 and the first cylinder 202 define a variable volume compression chamber 234 in the compression cylinder 202. The cylinder head 230, the power piston 220 and the second cylinder 204 define a variable volume combustion chamber 232 in the power cylinder 204.

The crankshaft 206 includes axially displaced and angularly offset first and second crank throws 226, 228, having a phase angle 236 therebetween. The first crank throw 226 is pivotally joined by a first connecting rod 238 to the compression piston 210, and the second crank throw 228 is pivotally joined by a second connecting rod 240 to the power piston 220 to reciprocate the pistons in their respective cylinders in a timed relation determined by the angular offset of the crank throws and the geometric relationships of the cylinders, crank, and pistons. Alternative mechanisms for relating the motion and timing of the pistons can be utilized if desired. The rotational direction of the crankshaft and the relative motions of the pistons near their bottom dead center (BDC) positions are indicated by the arrows associated in the drawings with their corresponding components.

The cylinder head 230 includes any of various passages, ports, and valves suitable for accomplishing the desired purposes of the split-cycle air hybrid engine 200.

Valves in the cylinder head 230, which are similar to valves of the engine in FIG. 1, include four cam actuated poppet valves: an intake valve 208, an XovrC valve 214, an XovrE valve 216, and an exhaust valve 224. An air reservoir tank valve 252 is also provided. The poppet valves 208, 214, 216, 224 and the air reservoir tank valve 252 can be actuated by camshafts (not shown) having cam lobes for respectively actuating and engaging the valves 208, 214, 216, 224, 252.

A spark plug 222 is mounted in the cylinder head with electrodes extending into the combustion chamber 232 for igniting air fuel charges at precise times by an ignition control, not shown. It should be understood that the engine can also be a diesel engine and be operated without a spark plug. Moreover, the engine 200 can be designed to operate on any fuel suitable for reciprocating piston engines in general, such as hydrogen or natural gas.

The split-cycle air hybrid engine 200 also includes an air reservoir (tank) 242, which is operatively connected to the crossover passage 212 by the air reservoir tank valve 252. Embodiments with two or more crossover passages 212 may include a tank valve 252 for each crossover passage 212, which connect to a common air reservoir 242, or alternatively each crossover passage 212 may operatively connect to separate air reservoirs 242.

The tank valve 252 is typically disposed in an air tank port 254, which extends from the crossover passage 212 to the air tank 242. The air tank port 254 is divided into a first air tank port section 256 and a second air tank port section 258. The first air tank port section 256 connects the air tank valve 252 to the crossover passage 212, and the second air tank port section 258 connects the air tank valve 252 to the air tank 242. The volume of the first air tank port section 256 includes the volume of all additional recesses which connect the tank valve 252 to the crossover passage 212 when the tank valve 252 is closed. Preferably, the volume of the first air tank port section 256 is small relative to the volume of the crossover passage 212 (e.g., less than 25%). More preferably, the first air tank port section 256 is substantially non-existent, that is, the tank valve 252 is most preferably disposed such that it is flush against the outer wall of the crossover passage 212.

The tank valve 252 may be any suitable valve device or system. For example, the tank valve 252 may be a pressure activated check valve, or an active valve which is activated by various valve actuation devices (e.g., pneumatic, hydraulic, cam, electric, or the like). Additionally, the tank valve 252 may comprise a tank valve system with two or more valves actuated with two or more actuation devices.

The air tank 242 is utilized to store energy in the form of compressed air and to later use that compressed air to power the crankshaft 206. This mechanical means for storing potential energy provides numerous potential advantages over the current state of the art. For instance, the split-cycle air hybrid engine 200 can potentially provide many advantages in fuel efficiency gains and NOx emissions reduction at relatively low manufacturing and waste disposal costs in relation to other technologies on the market such as diesel engines and electric-hybrid systems.

The engine 200 typically runs in a normal operating mode (engine firing (EF) mode or sometimes called the normal firing (NF) mode) and one or more air hybrid modes. In the EF mode, the engine 200 functions normally as previously described in detail herein (i.e., with respect to FIG. 1), operating without the use of the air tank 242. In the EF mode, the air tank valve 252 remains closed to isolate the air tank 242 from the basic split-cycle engine. In the four air hybrid modes, the engine 200 operates with the use of the air tank 242.

Exemplary Air Hybrid Modes Include:

1) Air Expander (AE) mode, which includes using compressed air energy from the air tank 242 without combustion;

2) Air Compressor (AC) mode, which includes storing compressed air energy into the air tank 242 without combustion;

3) Air Expander and Firing (AEF) mode, which includes using compressed air energy from the air tank 242 with combustion; and 4) Firing and Charging (FC) mode, which includes storing compressed air energy into the air tank 242 with combustion.

Further details on air hybrid engines are disclosed in U.S. Pat. No. 7,353,786 entitled Split-Cycle Air Hybrid Engine and issued on Apr. 8, 2008; U.S. Pat. No. 7,603,970 entitled Split-Cycle Air Hybrid Engine and issued on Oct. 20, 2009; and U.S. Publication No. 2009/0266347 entitled Split-Cycle Air Hybrid Engine and published on Oct. 29, 2009, each of which is incorporated by reference herein in its entirety.

In order to operate the split-cycle engines 100, 200 described above at a high efficiency, a valve actuation system is required that is capable of (1) opening and closing the crossover valves at an extremely high speed, (2) providing a broad range of crossover valve opening and closing timings, and (3) allowing cycle-to-cycle variation in at least the closing timing. These requirements stem from the unique properties of split-cycle engines and, in particular, split-cycle air hybrid engines.

First, in these split-cycle engines, the dynamic actuation of the crossover valves (i.e. 114, 116, 214, 216) is very demanding. This is due to the fact that the crossover valves must achieve sufficient lift to fully transfer the fuel-air charge in a very short period of crankshaft rotation (possibly as little as 6 degrees CA) relative to that of a conventional engine, which normally actuates the valves for a period of at least 180 degrees CA. For example, when operating in EF mode, it is desirable to open the XovrE valve, transfer a fluid charge into the expansion cylinder, and close the XovrE valve while the expansion piston is very close to TDC. Thus, the XovrE valve must typically open and close in a window of about 30 degrees CA to about 35 degrees CA. Under full load conditions, this window is even smaller, perhaps as little as about 10 degrees CA to about 20 degrees CA.

Certain air hybrid modes introduce even more stringent requirements. In AEF mode, for example, a volume of compressed air is stored in the air reservoir 242. Shortly after the expansion piston reaches TDC, the XovrE valve is opened to direct a charge of compressed air (preferably with added fuel) from the reservoir 242 into the combustion chamber where it is then ignited during an expansion stroke. If the engine is operating under only part load and the air reservoir 242 is charged to a high pressure (e.g., above approximately 20 bar), the XovrE valve only needs to be opened for a very short period (e.g., about 6 degrees CA) to transfer the requisite mass of air and fuel into the combustion chamber 232. In other words, the relatively small mass of air-fuel mixture required for part-load operation will quickly flow into the combustion chamber when the air reservoir 242 is charged to a high pressure and therefore the XovrE valve need only open for a few degrees CA. The crossover valves must therefore be capable of actuation rates that are several times faster than the valves of a conventional engine, which means the valve train associated therewith must be stiff enough and at the same time light enough to achieve such fast actuation rates.

Meanwhile, other operating modes may require that the valves stay open for a relatively long period of time. For example, in AE mode, a volume of compressed air stored in the air reservoir 242 is delivered to the combustion chamber 232 without spark or added fuel, forcing the expansion piston down and providing power to the crankshaft. If, however, the air pressure remaining in the reservoir is low (e.g., less than approximately 15 bar) and there is a high torque requirement (e.g., when a vehicle being powered by the engine is accelerating up a hill), the XovrE valve must remain open much longer to allow a sufficient mass of compressed air into the expansion chamber. In some cases, this can be 100 degrees CA or more. Thus, large variations in closing timing are required, since the XovrE valve might need to close 6 degrees CA after opening in one operating mode while it may need to remain open for 100 degrees CA or more in other operating modes, as presented above.

The engines disclosed herein can also require large variations in the opening timing of the crossover valves 214, 216, especially in modes that involve charging the air reservoir (e.g., AC mode and FC mode). In AC mode for instance, the opening timing of the XovrC valve 214 will vary considerably depending on load and the pressure in the air reservoir 242. If the XovrC valve is opened before the pressure in the compression cylinder is greater than or equal to the pressure in the air reservoir, fluid in the air reservoir will undesirably flow back into the compression cylinder 234. The energy required to re-compress this backflow reduces the efficiency of the engine. Therefore, the XovrC valve should not be opened until the pressure in the compression cylinder matches or exceeds that of the air reservoir 242. Thus, a range of approximately 30 to 60 degrees CA of opening timing variability is required for the XovrC valve, depending on the pressure in the air reservoir.

Accordingly, the opening timing, closing timing, and/or various other engine valve parameters must be variable over a wide range of possible values in order to efficiently operate each of the various engine modes.

Moreover, these parameters must be, in some cases, adjustable on a cycle-to-cycle basis. For example, the XovrE valve 216 can be used for load control in operating modes that employ combustion (e.g., EF mode and AEF mode). By closing the XovrE valve at various points along the expansion piston's stroke, the mass of air/fuel supplied to the cylinder can be metered, thereby controlling the engine load. To achieve precise load control in this case, the actuation rate of the XovrE valve must be variable from one cycle to the next.

Existing valve actuation systems are simply incapable of meeting these requirements. They are either too heavy or not stiff enough to be actuated at the required speeds. In addition, they provide only a limited range of opening or closing variability and are not responsive enough for cycle-to-cycle variation.

SUMMARY

Devices and related methods are disclosed that generally involve variable actuation of engine valves. In one embodiment, a valve train for a split-cycle internal combustion engine or an air hybrid split-cycle engine is provided that meets the aforementioned requirements by combining a cam phaser for varying the opening timing of the engine valves, a dwell cam for providing a large maximum possible valve event (e.g., 50-100 degrees CA), and a high speed lost-motion system for varying the closing timing of the engine valves. The devices and methods disclosed herein also have application in conventional internal combustion engines and can be adapted to actuate inwardly-opening and/or outwardly-opening valves.

In one aspect of at least one embodiment of the invention, an engine is provided that includes a camshaft having at least one cam formed thereon, the at least one cam being configured to impart motion to at least one engine valve over a maximum valve event measured in degrees crank angle. The engine also includes a cam phaser that selectively adjusts a phase of the at least one cam relative to a crankshaft and a lost-motion system that selectively prevents the at least one cam from imparting motion to the at least one engine valve over the entire maximum valve event.

In another aspect of at least one embodiment of the invention, an adjustable mechanical element is provided that includes a bearing element having opposed convex bearing surfaces, a connecting arm having a proximal end and a distal end, the distal end being fixedly coupled to the bearing element and the proximal end having a cylinder or ball formed thereon, and an adjustable hydraulic tappet having a socket formed in one end thereof for receiving the cylinder or ball of the connecting arm.

In another aspect of at least one embodiment of the invention, a rocker is provided that includes a body portion having an opening formed therein for receiving a rocker shaft. The rocker also includes a first arm extending radially from the body and having a first rocker pad formed thereon for engaging an engine valve and a second arm extending radially from the body and having a second rocker pad formed thereon for engaging a motion element. The rocker further includes a third arm extending radially from the body, the third arm being engaged by a valve seating control device.

In another aspect of at least one embodiment of the invention, a method of varying the opening and closing timing of an engine valve is provided that includes varying the opening timing of the engine valve and varying the closing timing of the engine valve.

In another aspect of at least one embodiment of the invention, a method of actuating an engine valve is provided that includes rotating a cam having an eccentric portion such that the eccentric portion engages a first surface of a bearing element, thereby causing a second surface of the bearing element to engage a rocker coupled to the engine valve, the bearing element being disposed between the cam and the rocker. The method also includes adjusting an opening timing at which the eccentric portion first engages the bearing element by actuating a cam phaser to change a phase of the cam relative to a crankshaft. The method further includes adjusting a closing timing at which the engine valve begins to close such that the engine valve closes earlier than what is called for by the cam by at least partially withdrawing the bearing element from between the cam and the rocker.

In another aspect of at least one embodiment of the invention, an adjustable mechanical element is provided that includes a bell crank having first and second ends, the first end being rotatably mounted about a pivot point. The adjustable mechanical element also includes an adjustable hydraulic tappet configured to selectively apply force to the second end of the bell crank and a connecting arm having a proximal end and a distal end, the distal end being fixedly coupled to a bearing element and the proximal end being pivotally coupled to the bell crank at a location intermediate to the first and second ends.

In another aspect of at least one embodiment of the invention, a rocker assembly is provided that includes a rocker mounted to a rocker pedestal having an adjustable height and a wedge-shaped bearing element slidably disposed between first and second portions of the rocker pedestal. Withdrawing the wedge-shaped bearing element from between the first and second portions is effective to decrease the height of the pedestal.

In another aspect of at least one embodiment of the present invention, a locking knee assembly is provided that includes an outer housing slidably disposed relative to a lash cylinder, a femur having a first end and an opposed second end, the first end being rotatably coupled to an interior of the outer housing, and a shin rotatably coupled to the second end of the femur at a knee joint. The assembly also includes a hydraulic actuation piston configured to selectively apply a force to the knee joint to hold the femur in a fixed angular orientation relative to the shin.

The present invention further provides devices, systems, and methods as claimed.

BRIEF DESCRIPTION OF THE DRAWINGS

The invention will be more fully understood from the following detailed description taken in conjunction with the accompanying drawings, in which.

DETAILED DESCRIPTION

Certain exemplary embodiments will now be described to provide an overall understanding of the principles of the structure, function, manufacture, and use of the devices and methods disclosed herein. One or more examples of these embodiments are illustrated in the accompanying drawings. Those skilled in the art will understand that the devices and methods specifically described herein and illustrated in the accompanying drawings are non-limiting exemplary embodiments and that the scope of the present invention is defined solely by the claims. The features illustrated or described in connection with one exemplary embodiment may be combined with the features of other embodiments. Such modifications and variations are intended to be included within the scope of the present invention.

Although certain methods and devices are disclosed herein in the context of a split-cycle engine and/or an air hybrid engine, a person having ordinary skill in the art will appreciate that the methods and devices disclosed herein can be used in any of a variety of contexts, including, without limitation, non-hybrid engines, two-stroke and four-stroke engines, conventional engines, diesel engines, etc.

As explained above, in order to operate the split-cycle engines disclosed herein at maximum efficiency, and in particular to operate each of the various air hybrid modes contemplated herein, it is desirable to vary the opening timing, opening rate, closing timing, closing rate, lift, and/or various other engine valve parameters.

Figure 1:
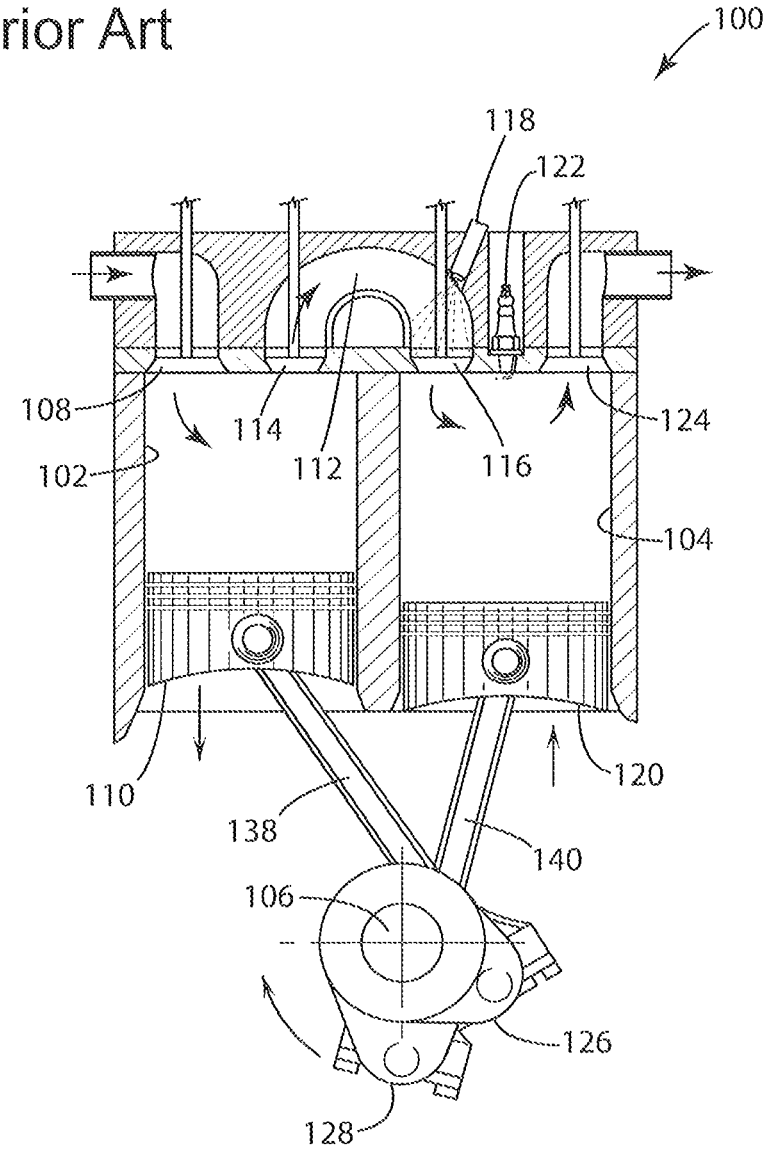
FIG. 1 Prior Art
FIG. 1 is a schematic cross-sectional view of a prior art split-cycle engine.
Figure 2:
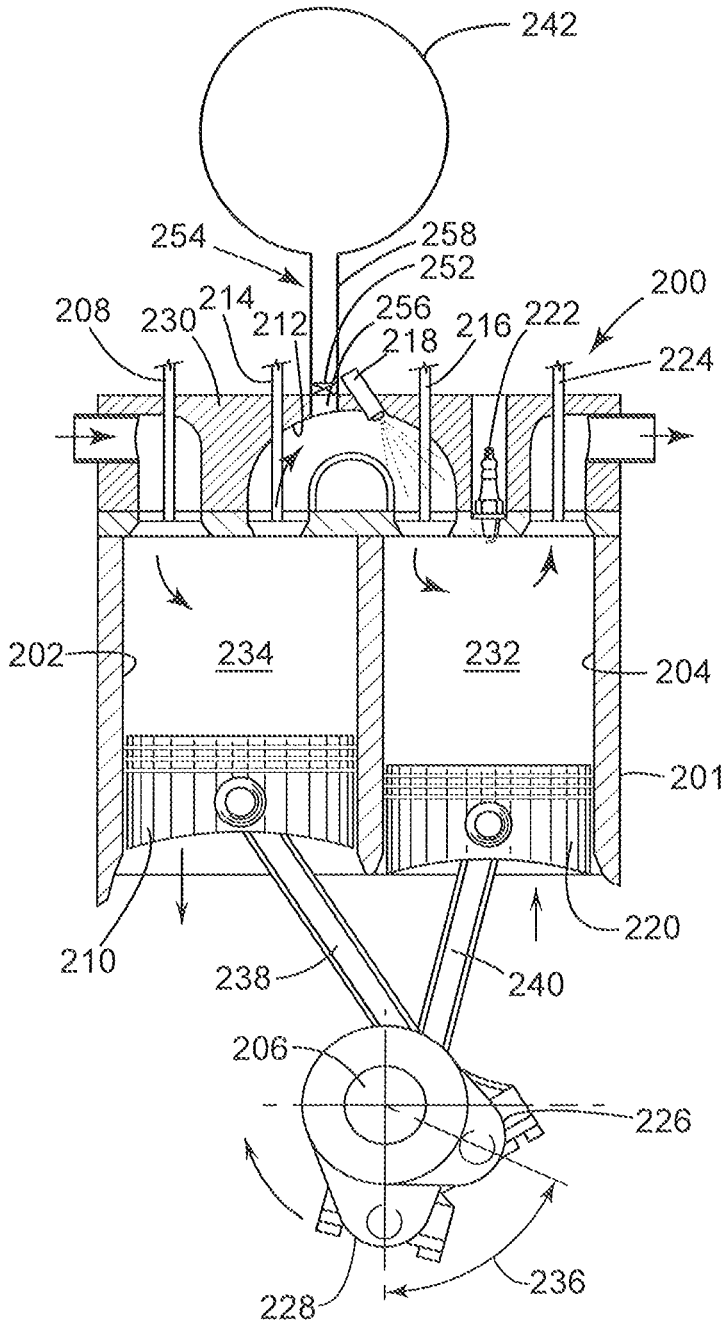
FIG. 2 Prior Art
FIG. 2 is a schematic cross-sectional view of a prior art air hybrid split-cycle engine.
Figure 3A:
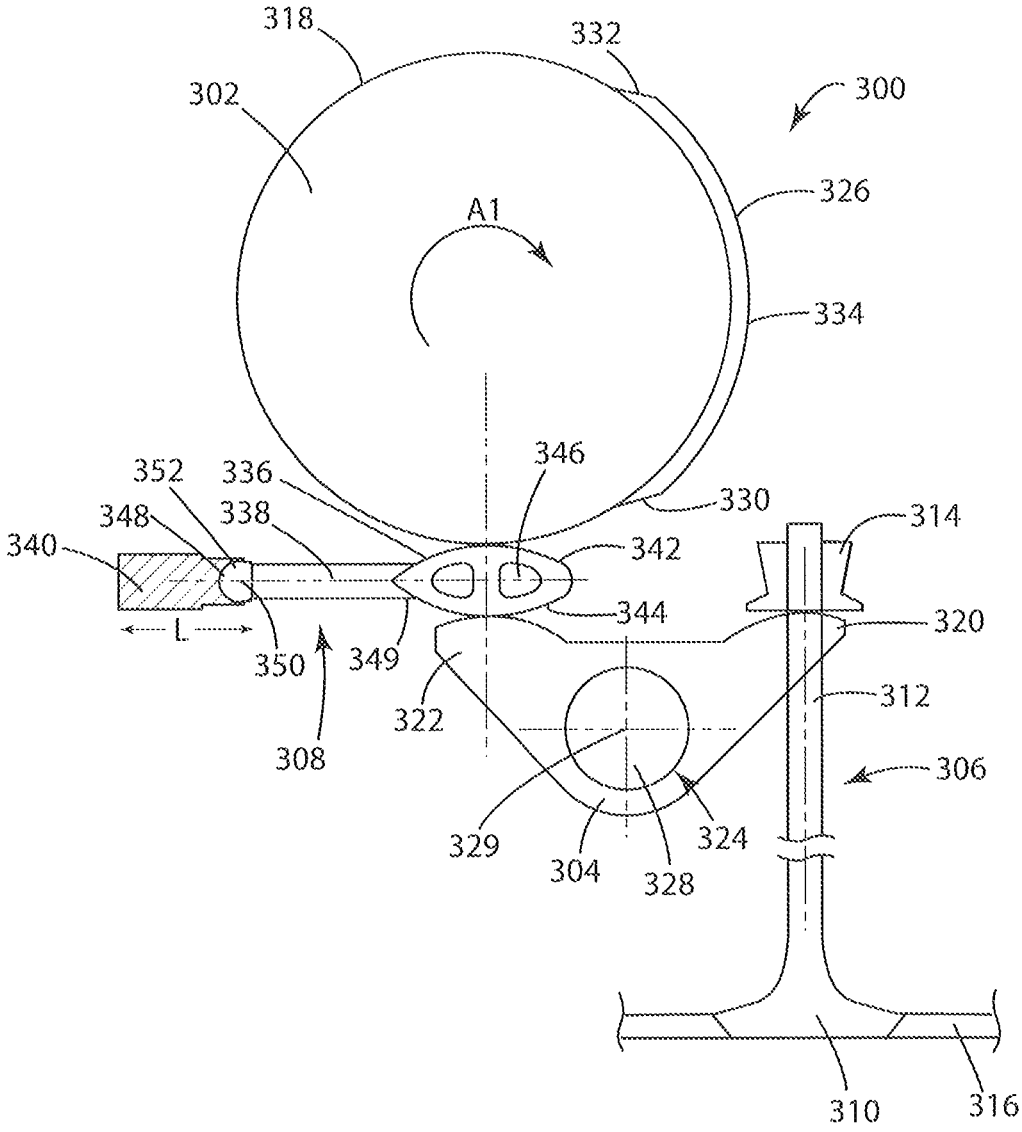
FIG. 3A is a schematic view of one embodiment of a valve train according to the present invention in which a valve is closed.
Figure 3B:
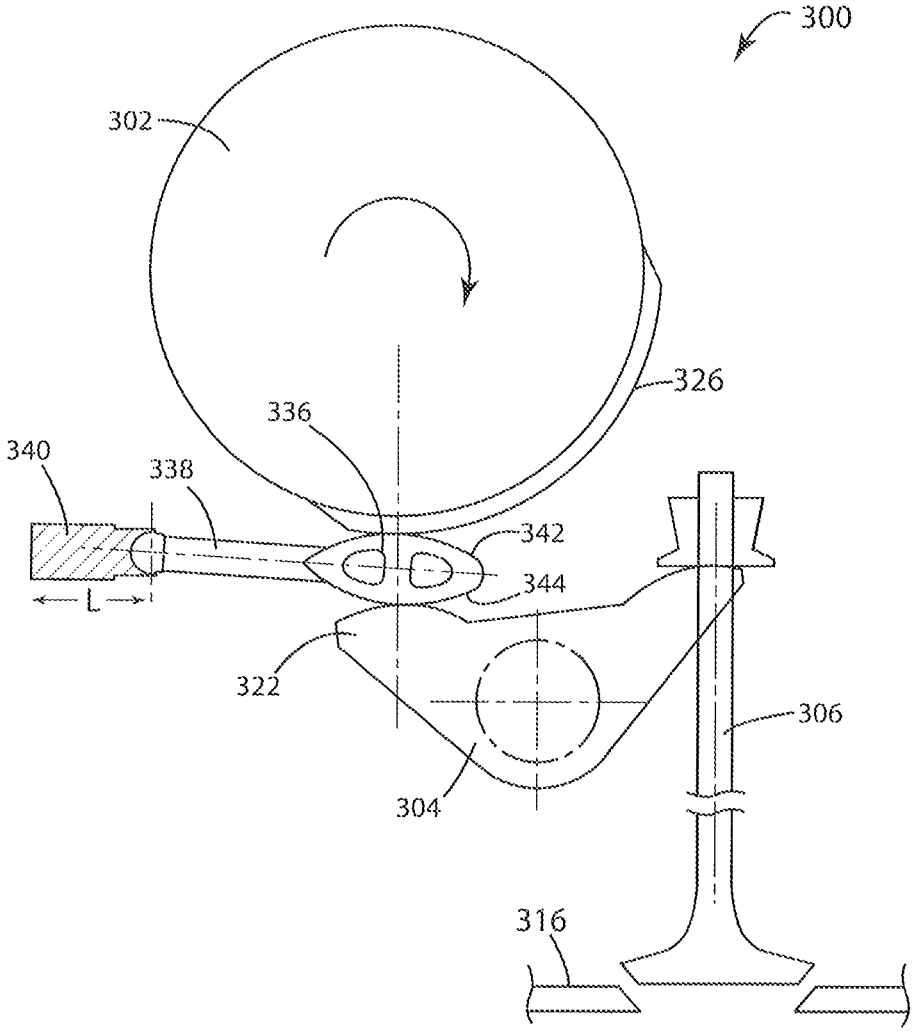
FIG. 3B is a schematic view of the valve train of FIG. 3A in which the valve is opened.
Figure 3C:
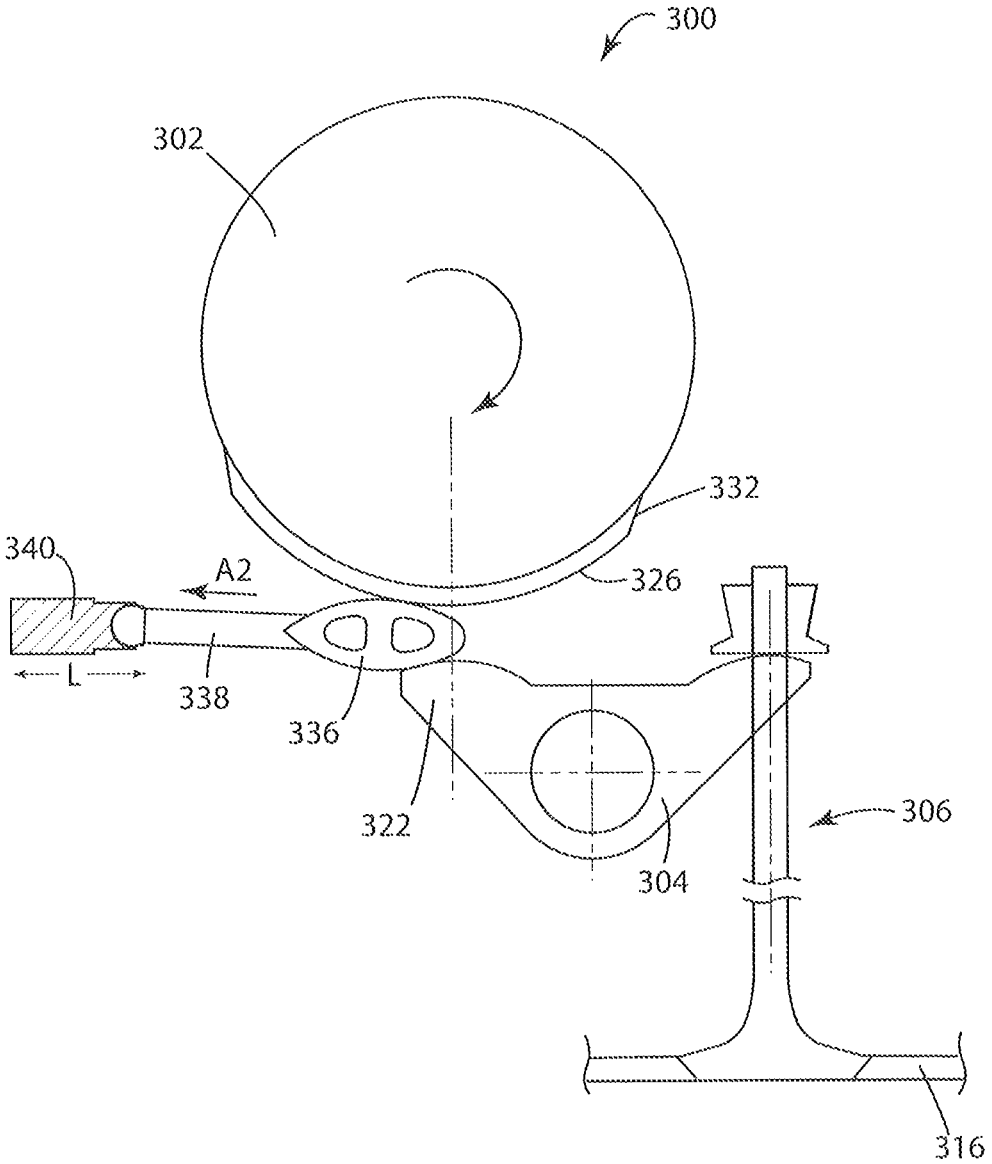
FIG. 3C is a schematic view of the valve train of FIGS. 3A and 3B in which the valve is closed earlier than what is called for by a profile of a cam.

FIGS. 3A-3C illustrate one exemplary embodiment of a valve train suitable for adjusting the aforementioned valve parameters (i.e., by modifying the valve motion proscribed by a cam profile). The illustrated valve train can be used to actuate any of the valves of the engines 100, 200, including without limitation the XovrC and XovrE crossover valves. For purposes herein, a valve train of an internal combustion engine is defined as a system of valve train elements, which are used to control the actuation of the valves. The valve train elements generally comprise a combination of actuating elements and their associated support elements. The actuating elements (e.g., cams, tappets, springs, rocker arms, and the like) are used to directly impart the actuation motion to the valves (i.e., to actuate the valves) of the engine during each valve event. The support elements (e.g., shafts, pedestals or the like) securely mount and guide the actuating elements.

As shown in FIG. 3A, the valve train 300 generally includes a cam 302, a rocker 304, a valve 306, and an adjustable mechanical element 308. The valve train 300 can also include one or more associated support elements, which for purposes of brevity are not illustrated.

The valve 306 includes a valve head 310 and a valve stem 312 extending vertically from the valve head 310. A valve adapter assembly 314 is disposed at the tip of the stem 312 opposite the head 310 and is securely fixed thereto. A valve spring (not shown) holds the valve head 310 securely against a valve seat 316 when the valve 306 is in its closed position. Any of a variety of valve springs can be used for this purpose, including, for example, air or gas springs. In addition, although the illustrated valve 306 is an outwardly-opening poppet valve, any cam actuated valve can be used, including inwardly-opening poppet valves, without departing from the scope of the present invention.

The rocker 304 includes a forked rocker pad 320 at one end, which straddles the valve stem 312 and engages the underside of the valve adapter assembly 314. Additionally, the rocker 304 includes a solid rocker pad 322 at an opposing end, which slidably contacts the adjustable mechanical element 308. The rocker 304 also includes a rocker shaft bore 324 extending therethrough. The rocker shaft bore 324 is disposed over a supporting rocker shaft 328 such that the rocker 304 rotates on the rocker shaft 328 about an axis of rotation 329.

The forked rocker pad 320 of the rocker 304 contacts the valve adapter assembly 314 of the outwardly-opening poppet valve 306 such that a downward direction of the rocker pad 322 caused by the actuation of the cam 302 and adjustable mechanical element 308 translates into an upward movement of the rocker pad 320, which in turn opens the valve 306. The geometry of the rocker 304 is selected to achieve a desired ratio of the distance between the forked rocker pad 320 and the axis of the rocker rotation 329 to the distance between the rocker pad 322 and the axis of rocker rotation 329. In one embodiment, this ratio can be between about 1:1 and about 2:1, and preferably about 1.3:1, about 1.4:1, about 1.5:1, about 1.6:1, or about 1.7:1.

The cam 302 is a "dwell cam," which as used herein is a cam that includes a dwell section (i.e., a section of the eccentric portion of the cam having a constant radius) of at least 5 degrees CA. In the illustrated embodiment, the dwell cam 302 rotates clockwise (in the direction of the arrow A1). The dwell cam 302 generally includes a base circle portion 318 and an eccentric portion 326. As the eccentric portion 326 of the cam 302 contacts the adjustable mechanical element 308, the adjustable mechanical element pivots, which then causes the rocker 304 to rotate about the rocker shaft 328 to lift the valve 306 off of its seat 316.

The eccentric portion 326 comprises an opening ramp 330, a closing ramp 332, and a dwell section 334. The dwell section 334 can be of various sizes, (i.e., at least 5 degrees CA) and in the illustrated embodiment, is sized to match the longest possible valve event duration (i.e., maximum valve event) needed over a full range of engine operating conditions and/or air hybrid modes. For purposes herein, the dwell section 334 is referred to as being part of the eccentric portion 326 of the cam 302, even though the dwell section 334 is concentric with the base circle portion 318 of the cam 302 in the illustrated embodiment. The opening ramp 330 of the cam 302 is contoured to a shape that adequately achieves the desired lift of the engine valve 306 at the desired rate. The closing ramp 332 (or "landing" ramp) is shaped to rapidly decelerate the velocity of the valve 306 as it approaches the valve seat 316 and/or provide for refill or resetting of an adjustable hydraulic tappet 340, as discussed below. Further detail on dwell cams can be found in U.S. application Ser. No. 13/359,525, filed on an even date herewith, entitled "SPLIT-CYCLE AIR HYBRID ENGINE WITH DWELL CAM," which is hereby incorporated by reference in its entirety.

The adjustable mechanical element 308 is used to selectively vary the lift and the opening and closing parameters of the valve 306. In the embodiment of FIGS. 3A-3C, the adjustable mechanical element 308 includes a bearing element 336, a connecting arm 338, and an adjustable hydraulic tappet 340.

As shown, the bearing element 336 has a generally elliptical-shaped cross-section defined by opposed first and second bearing surfaces 342, 344, each having a generally convex profile. The bearing surfaces 342, 344 can have any of a variety of cross-sectional shapes, including circular and elliptical. In some embodiments, the bearing surfaces 342, 344 can be sections of circles having different radii of curvature (e.g., such that the bearing surface 342 has a radius of curvature that is less than a radius of curvature of the bearing surface 344). The bearing element 336 is selectively positioned between the cam 302 and the rocker 304 such that the first bearing surface 342 slidably engages the cam 302 and the second bearing surface 344 slidably engages the rocker pad 322. The bearing element 336 has one or more cavities 346 formed therein, for example to reduce the overall mass of the bearing element 336 and thus facilitate faster actuation.

The bearing element 336 is coupled to the adjustable hydraulic tappet 340 via at least one connecting arm 338. The connecting arm 338 in the illustrated embodiment is a generally cylindrical arm having a proximal end 348 and a distal end 349. In some embodiments, the connecting arm 338 can have the shape of an I-beam. The distal end 349 of the connecting arm 338 is coupled to the bearing element 336 while the proximal end 348 of the connecting arm 338 is coupled to the tappet 340.

The connecting arm 338 can be mated to the tappet 340 and to the bearing element 336 in a variety of ways. For example, the connecting arm 338 can be fixedly mated to the tappet 340 and/or the bearing element 336 with, for example, a screw, bolt, snap-fit engagement, etc., can be formed integrally with the tappet 340 and/or the bearing element 336, or can be pivotally mated to either or both of the tappet 340 and the bearing element 336. In the illustrated embodiment, the connecting arm 338 is formed integrally with the bearing element 336. The proximal end 348 of the connecting arm 338 has a generally spherical ball 350 formed thereon. In some embodiments, the spherical ball 350 can be replaced with a cylindrical bearing. The ball 350 is sized and otherwise configured to be received by a corresponding socket 352 formed in a distal end of the tappet 340, such that the connecting arm 338 is pivotable with respect to the tappet 340. In other words, the connecting arm 338 is free to rotate about a plurality of rotational axes substantially transverse to a longitudinal axis of the tappet 340. In embodiments in which a cylindrical bearing is used, rotation of the connecting arm 338 can be limited to rotation about a single axis that is substantially transverse to the longitudinal axis of the tappet 340. The connecting arm 338 can also be mated to the tappet 340 such that it rotates about a pivot pin, axle, or other coupling. Although the bearing element 336 is formed integrally with the connecting arm 338 in the illustrated embodiment, it can also be pivotally coupled thereto using any of the techniques described above for mating the connecting arm 338 to the tappet 340.

The tappet 340 is adjustable such that the connecting arm 338 and the bearing element 336 coupled thereto can be selectively advanced towards or retracted from the cam 302 and rocker 304 (i.e., in a lateral direction).

In one embodiment, the tappet 340 is configured to exert both a pulling force and a pushing force on the connecting arm 338 and the bearing element 336. For example, the tappet 340 can define an internal cavity in which a piston is slidably received. The piston forms a seal with the inner surface of the cavity such that first and second fluid chambers are defined thereby, one on each side of the piston. The piston is operatively coupled to the socket 352 and/or the connecting arm 338 such that linear motion of the piston imparts a corresponding linear motion to the connecting arm. The first and second fluid chambers defined within the tappet 340 are selectively filled with and drained of a hydraulic fluid to move the piston (and thus the bearing element 336) towards or away from the cam 302 and the rocker 304.

Alternatively, the tappet 340 can be configured only to exert a pushing force on the bearing element 336, in which case forces supplied by the cam, the rocker, and/or one or more bias springs are used to force the bearing element 336 into a retracted position. For example, the tappet 340 can include first and second cylindrical telescoping halves defining a fluid chamber between the respective interiors thereof. When the tappet 340 is actuated, fluid can be displaced from the fluid chamber into a hydraulic accumulator allowing the first and second telescoping halves to slide relative to and towards one another, thereby reducing the overall length L of the tappet 340. In one embodiment, the tappet can be actuated by a solenoid valve and a check valve in communication with the hydraulic circuit including the fluid chamber and accumulator. The solenoid valve can be maintained in a closed position in order to retain hydraulic fluid in the circuit. As long as the solenoid valve remains closed, the length L of the tappet 340 remains substantially constant. When the solenoid valve is opened temporarily, the circuit partially drains, allowing the tappet 340 to partially or fully collapse, thus reducing the length L thereof. When the solenoid valve is again closed, the accumulator selectively refills the tappet 340, causing it to expand linearly such that the overall length L thereof is increased.

Although the illustrated embodiment includes a hydraulic tappet 340 to advance and/or retract the connecting arm 338 and the bearing element 336, a variety of other mechanisms can be employed for this purpose without departing from the scope of the present invention. For example, pneumatic, mechanical, electrical, and/or electromagnetic actuators can be used to impart motion to the connecting arm 338 and/or bearing element 336. As discussed in further detail below, the tappet 340 can be mechanically locked and hydraulically actuated (i.e., a hydraulic system can be used to engage and disengage a mechanical locking device).

In operation, the cam 302 rotates clockwise as a camshaft to which it is mounted is driven by rotation of the engine's crankshaft. As shown in FIG. 3A, when the base circle portion 318 of the cam 302 engages the bearing element 336, the rocker 304 remains in a "fully closed" position in which the forked rocker pad 320 does not apply sufficient lifting force to the valve 306 to overcome the bias of the valve spring, and therefore the valve 306 remains closed. In the illustrated embodiment, the thickness of the bearing element 336 and the spacing between the cam 302 and rocker 304 are sized such that even when the thickest portion of the bearing element 336 is positioned between the base circle portion 318 of the cam 302 and the rocker 304, the valve 306 remains closed.

As shown in FIG. 3B, the eccentric portion 326 of the cam 302 engages the first bearing surface 342 of the bearing element 336 during a portion of the cam's rotation. The eccentric portion 326 imparts a downward motion to the bearing element 336, causing the connecting arm 338 to pivot in a clockwise direction about the distal end of the tappet 340. As the connecting arm 338 pivots, some or all of the downward motion of the bearing element 336 is imparted to the rocker 304, which engages the second bearing surface 344 of the bearing element 336. This results in a counterclockwise rotation of the rocker 304, which in turn is effective to lift the valve 306 off of the seat 316. Because the bearing surfaces 342, 344 are curved such that the bearing element 336 has a variable thickness along a length thereof, the degree to which the valve 306 is lifted can be controlled by varying the degree to which the bearing element 336 is inserted between the cam 302 and the rocker 304. For example, in FIG. 3B, the bearing element 336 is inserted such that the thickest portion thereof is disposed between the thickest portion of the rocker pad 322 and the cam 302, thereby imparting maximum lift to the valve 306. A reduced valve lift is achieved by withdrawing the bearing element 336 slightly in the direction of the tappet 340, as explained below. Since the solenoid valve (not shown) is closed in FIG. 3B, the length L of the tappet 340 remains substantially constant and some or all of the motion imparted to the bearing element 336 is transferred to the valve 306, lifting it off of the seat 316. In other words, with the tappet 340 maintained at a constant length, the motion of the valve 306 will depend on the shape of the profile of the cam 302.

As shown in FIG. 3C, the valve train 300 is capable of closing the valve before the closing ramp 332 of the cam 302 reaches the bearing element 336, and is capable of reducing the degree to which the valve 306 is opened. For example, the solenoid valve can be actuated to allow a sudden release of hydraulic fluid from the fluid chamber of the tappet 340. When the fluid is allowed to escape the tappet 340, a squeezing force acting on the bearing element 336 in the direction of the arrow A2 is effective to push the bearing element 336 away from the cam 302 and the rocker 304, compressing or collapsing the tappet 340 and forcing hydraulic fluid through the open solenoid valve. The squeezing force is generated by the combined force of the valve spring biasing the rocker arm 304 in a clockwise direction, coupled with the force of the cam's eccentric portion 326 rotating against the bearing element 336 in a clockwise direction. It will be appreciated that the squeezing force can be only a minor component of the force acting on the bearing element 336, and that the bearing element 336 can be shaped such that the majority of the force of the cam 302 is applied downwards onto the rocker pad 322 and vice versa. It will also be appreciated that the degree to which the bearing element 336 is forced out from between the cam 302 and the rocker 304, and thus the degree to which the valve 306 is allowed to close, can be controlled by adjusting the degree to which hydraulic fluid is permitted to escape from the tappet 340. In other words, if the solenoid valve is opened briefly and then immediately closed, the tappet 340 will only collapse to a degree corresponding to the amount of fluid displaced from the fluid chamber, in which case the valve 306 will only partially close. This can be desirable when it is necessary to adjust the lift height of the valve 306. Alternatively, the solenoid valve can be left open for a period long enough for the tappet 340 to compress far enough to allow the valve 306 to fully close.

In embodiments in which the tappet 340 is configured to both push and pull the connecting arm 338 and bearing element 336, the tappet 340 can be controlled to actively pull the bearing element 336 away from the cam 302 and the rocker 304, instead of relying on the aforementioned squeezing force.

In FIG. 3C, the bearing element 336 is shown withdrawn far enough from the cam 302 and the rocker 304 such that insufficient motion is imparted from the eccentric portion 336 of the cam 302 to the rocker 304 for the valve 306 to actually be lifted off of the seat 316, and thus the valve 306 closes or remains closed. The valve train 300 thus provides a lost-motion feature that allows for variable valve actuation (i.e., permits the valve 306 to close at an earlier time than that provided by the profile of the cam 302). Furthermore, the valve train 300 permits the lift of the valve 306 to be varied, for example by varying the degree to which fluid is drained from the tappet 340 and thus the degree to which the valve is allowed to open or close. The valve train 300 is thus configured to transmit all of the cam motion to the valve 306, to transmit only a portion of the cam motion to the valve 306, or to transmit none of the cam motion to the valve 306.

The adjustable mechanical element 308 can also be configured to take up any lash that may exist in the valve train 300, for example due to thermal expansion and contraction, component wear, etc. For purposes herein, the terms "valve lash" or "lash" are defined as the total clearance existing within the valve train 300 when the valve 306 is fully seated. The valve lash is equal to the total contribution of all the individual clearances between all individual valve train elements (i.e., actuating elements and support elements) of the valve train 300. In the valve train 300, the bearing element 336 is biased towards the cam 302 and the rocker 304 such that any lash that may exist in the valve train 300 is taken up by the gradually increasing thickness of the bearing element 336. The biasing force can be relatively low, such that once the lash is taken up by the bearing element 336, the bearing element 336 is not advanced further towards the cam 302 or rocker 304 unless actuated to open the valve 306. In this manner, the lash is taken up without the valve 306 opening during a period when it should be closed. The biasing force can be supplied in a variety of ways, for example hydraulically, via one or more springs, or via a well-known hydraulic lash adjuster integrally attached to the tappet.

FIGS. 4A-4D illustrate one embodiment of a locking knee tappet 440 that can be used in place of the hydraulic tappet 340 discussed above to selectively advance and/or retract the connecting arm 338 and the bearing element 336. As shown particularly in FIGS. 4A-4B, the tappet 440 generally includes an outer housing 433 slidably disposed in a lash cylinder 435 such that a variable-volume, oil-filled, lash plenum 437 is defined therebetween. A locking knee joint defined by a femur 479 and a shin 439 is disposed within the outer housing 433. Flexion of the knee joint is controlled/restricted by a hydraulic actuation piston 441 and a femur support platform 443. The distal end 445 of the shin 439 is coupled to a foot 451 that is slidably guided along a substantially linear path by opposed guide plates 453. The distal end 455 of the foot 451 can be coupled to the connecting arm 338 described above or, alternatively, can be coupled directly to the bearing element 336 described above.

The femur 479 has a generally rectangular cross-section and includes a central portion 457, a proximal end 459, and a distal end 461. The proximal end 459 of the femur 479 is radiused so as to form an elongated hemi-cylindrical edge 463. The hemi-cylindrical edge 463 is received in a corresponding hemi-cylindrical slot 465 formed in an upright portion 467 of the femur support platform 443, which is in turn fixedly mated to the outer housing 433. Accordingly, the femur 479 is rotatable relative to the platform 443 and the outer housing 433. The platform 443 includes a base portion 469 configured to limit the range over which the femur 479 can be rotated. In one embodiment, the base portion 469 is sized and positioned such that an angle A (FIG. 4C) between the femur 479 and the outer housing 433 cannot be less than approximately 8 degrees. It will be appreciated that the hemi-cylindrical edge 463 of the femur 479 can have a thickness greater than the central portion 457 of the femur 479, and the sidewalls of the hemi-cylindrical slot 465 can be extended such that the edge 463 is captive within the slot 465. It will further be appreciated that the term "hemi-cylindrical" as used herein is not limited to shapes having a constant radius or that form exactly half of a cylinder, but rather encompasses a variety of similar shapes. In addition, any of the hemi-cylindrical male-female interfaces described herein can be replaced with a comparable joining mechanism, such as a ball and socket joint, a universal joint, a continuously variable joint, a pin and sleeve joint, etc.

Figure 4A:
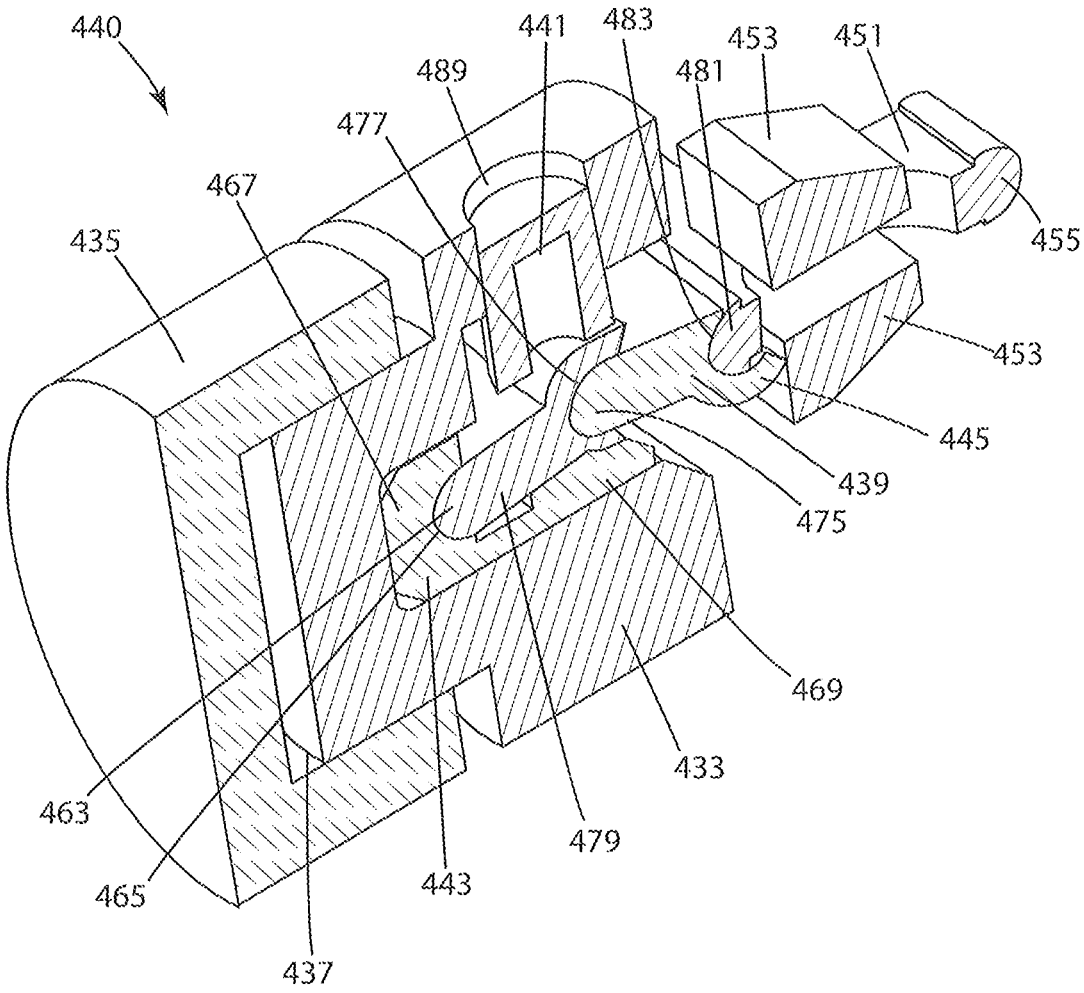
FIG. 4A is a perspective cross-sectional view of one embodiment of a locking knee tappet according to the present invention.
Figure 4B:
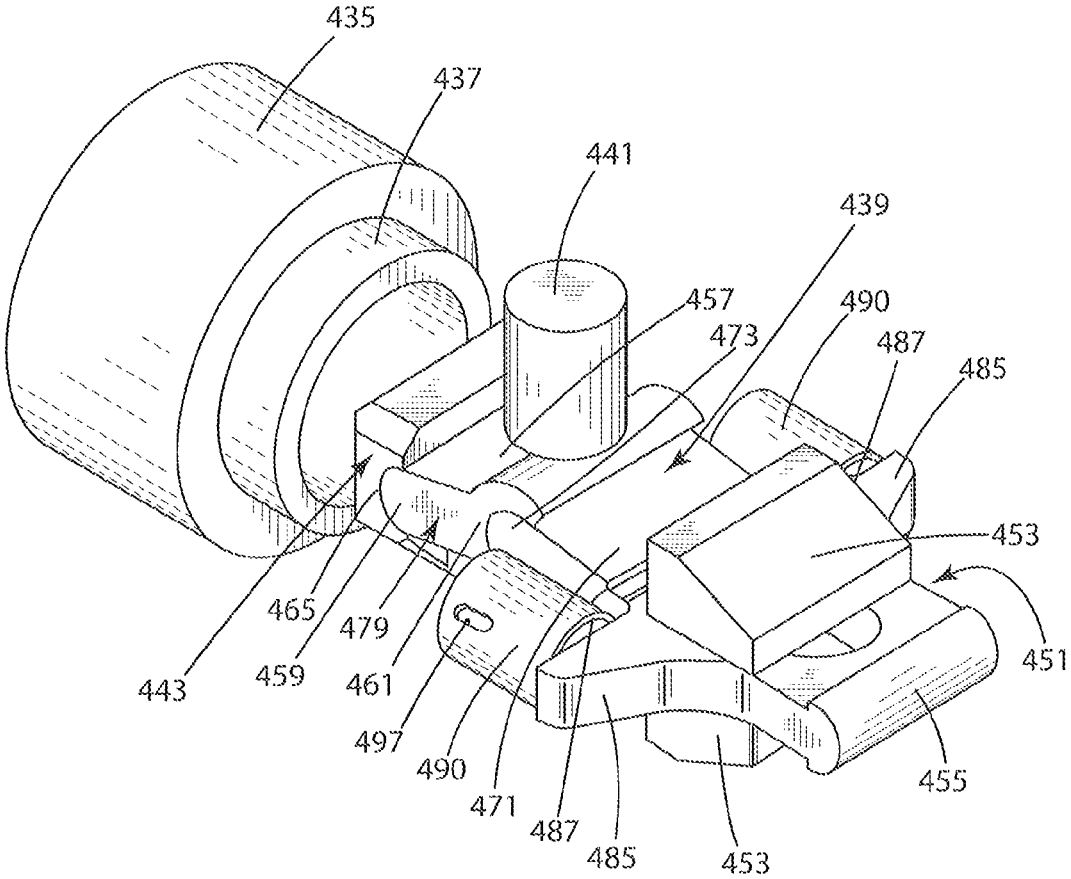
FIG. 4B is a perspective view of the locking knee tappet of FIG. 4A with a portion of the outer housing not shown.
Figure 4C:
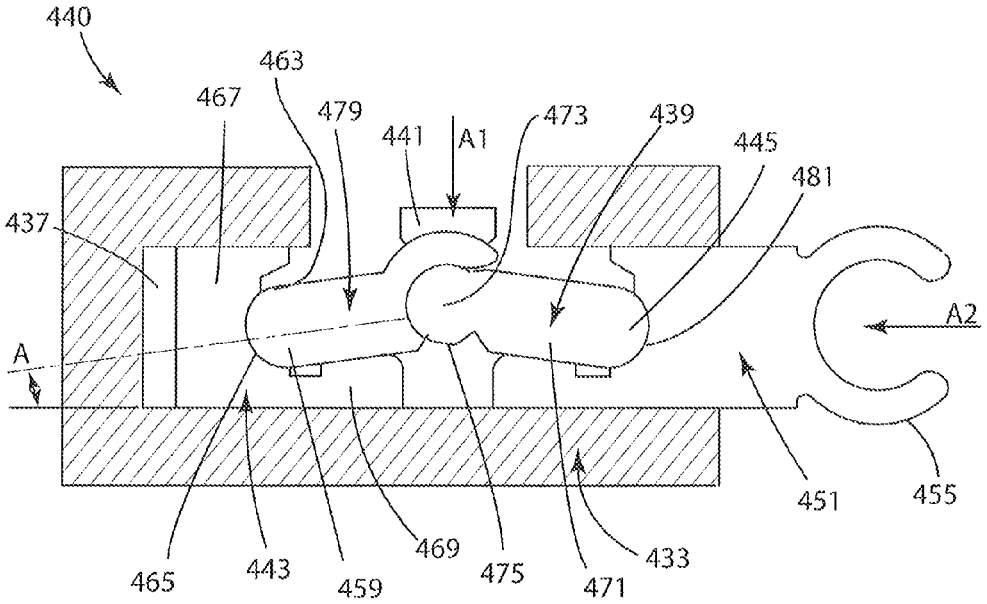
FIG. 4C is a schematic cross-sectional side view of the locking knee tappet of FIGS. 4A-4B in an extended configuration.
Figure 4D:
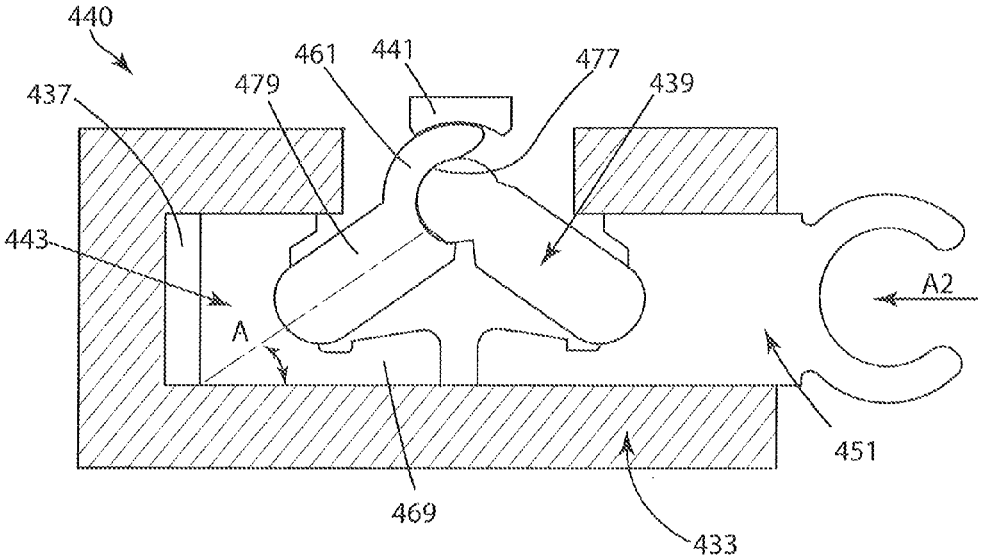
FIG. 4D is a schematic cross-sectional side view of the locking knee tappet of FIGS. 4A-4C in a retracted configuration.

The shin 439 also has a generally rectangular cross-section and includes a central portion 471, a proximal end 473, and a distal end 445. The proximal end 473 of the shin 439 is radiused so as to form an elongated hemi-cylindrical edge 475. The hemi-cylindrical edge 475 is received in a corresponding hemi-cylindrical slot 477 formed in the distal end 461 of the femur 479 such that the shin 439 is rotatable relative to the femur 479. The foot 451 likewise has a generally rectangular cross-section and includes a radiused proximal end 481 for mating with a corresponding slot 483 formed in the distal end 445 of the shin 439 such that the foot 451 is rotatable relative thereto. The male/female relationship of the shin 439 and the foot 451 can also be reversed, as shown in FIGS. 4C and 4D, as can the male/female relationship of any of the other components of the locking knee tappet 440. The foot 451 also includes a mating feature (e.g., a male tab as shown in FIGS. 4A-4B or a female receptacle as shown in FIGS. 4C-4D) formed on the distal end 455 thereof for coupling to the connecting arm 338 or bearing element 336 described above. Alternatively, the bearing element 336 can be formed integrally with the foot 451. As shown in FIG. 4B, the foot 451 can optionally include opposed lateral ears 485 coupled to respective valve catch pistons 487, the operation of which is described further below.

The hydraulic actuation piston 441 is reciprocally and sealably disposed within a cylindrical bore 489 formed in the sidewall of the outer housing 433 and is positioned to engage either the femur 479 or the shin 439, preferably at a "knee" where the femur 479 and the shin 439 are rotatably coupled to one another. A hydraulic control circuit (not shown) is coupled to the hydraulic actuation piston 441 such that hydraulic pressure acting to push the piston 441 towards the "knee" can be selectively applied and relieved.

In operation, referring now to the schematic illustrations of FIGS. 4C and 4D, the locking knee tappet 440 has two general configurations. FIG. 4C illustrates an extended configuration of the tappet 440 in which the femur 479 is rotated against the base portion 469 of the femur support platform 443 such that the femur 479 forms a relatively small angle A (e.g., approximately 8 degrees) with the outer housing 433. The hydraulic control circuit (not shown) is controlled to maintain the hydraulic pressure that is exerted on the hydraulic actuation piston 441 such that the piston 441 exerts a holding force in the direction of the arrow A1 against the "knee" (e.g., against the femur 479 as shown). This force prevents the knee from articulating when a lateral force is applied in the direction of the illustrated arrow A2 (e.g., when an eccentric portion of a cam contacts a bearing element coupled to the end of the foot 451).

When it is desired to close an engine valve earlier than what is called for by its corresponding cam (e.g., by withdrawing a bearing element from between the cam and a rocker as described above), the locking knee tappet 440 is transitioned to a retracted configuration, as shown in FIG. 4D. When early valve closing is requested, a solenoid or other control valve in the hydraulic control circuit is opened to allow fluid holding the hydraulic actuation piston 441 in place to flow into an accumulator. Once the control valve is opened, the lateral component of the force exerted on the foot 451 by the cam and the rocker in the direction of the arrow A2 forces the femur-shin joint to articulate, driving the hydraulic actuation piston 441 upwards and forcing hydraulic fluid through the control valve and into the accumulator. In one embodiment, the femur 479 forms a 35 degree angle A with respect to the outer housing 433 when fully articulated. Once the eccentric portion of the cam has rotated past the rocker, the accumulator refills the fluid chamber above the hydraulic actuation piston 441 and the control valve is closed, again locking the tappet 440 in the extended configuration.

The femur 479 and shin 439 are prevented from being "over-indexed" (e.g., articulating such that the angle A in FIGS. 4C and 4D is 0 degrees or a negative angle) by the base portion 469 of the femur support platform 443, which defines a minimum angle A. In an alternative embodiment, however, the femur support platform 443 can be shaped differently or omitted altogether such that the femur 479 and shin 439 can be over-indexed. For example, the femur 479 and the shin 439 can be positioned such that a central longitudinal axis of the femur 479 is collinear with a central longitudinal axis of the shin 439. In this embodiment, a second hydraulic actuation piston is provided on the opposite side of the femur 479 from the hydraulic actuation piston 441 to actively buckle the knee when lost-motion is required.

When the hydraulic actuation piston 441 is "unlocked" to allow the femur 479 and the shin 439 to articulate, the rate of articulation (and thus the rate at which the bearing element is withdrawn and the engine valve is closed) is controlled for at least a portion of the valve closing event by the valve catch pistons 487 (FIG. 4B) to which the foot 451 is coupled. The valve catch pistons 487 are disposed in corresponding valve catch cylinders 490 formed in the outer housing 433. The valve catch cylinders 490 have one or more orifices 497 formed in the sidewalls thereof and are filled with hydraulic fluid. As the valve catch pistons 487 are driven into the valve catch cylinders 490 by retraction of the foot 451, the hydraulic fluid contained in the cylinders 490 is ejected through the orifices 497. As the pistons 487 are advanced deeper into the cylinders 490, the orifices 497 are progressively occluded by the pistons 487, restricting the rate at which hydraulic fluid can escape from the cylinders 490. This rate restriction is effective to slow the movement of the pistons 487, which ultimately reduces the closing velocity of the engine valve. It will thus be appreciated that the orifices 497 are sized, shaped, and positioned such that the speed of the engine valve is greatly reduced as the valve approaches its corresponding valve seat, thereby "catching" the valve and preventing it from crashing against the seat and damaging the engine. While two valve catch cylinder 490 and piston 487 combinations are shown in the illustrated embodiment, any number can be employed without departing from the scope of the present invention, such as zero, one, or more than two.

Throughout the operation of the locking knee tappet 440, the outer housing 433 remains slidably disposed within the lash cylinder 435, which is held in a fixed position relative to the valve train in which the tappet 440 is used. Pressurized hydraulic fluid applied to the lash plenum 437 is therefore effective to bias the outer housing 433 (and the bearing element coupled indirectly thereto) towards the cam and the rocker. Accordingly, the tappet 440 provides an automatic valve lash adjustment feature by which lash existing in the valve train is taken up by the graduated thickness of the bearing element 336.

Additionally, the surface area of the outer housing 433, which defines the lash plenum 437 and upon which hydraulic pressure is applied to minimize lash, is significantly larger (e.g., 2 to 1, 3 to 1, 4 to 1 or greater) than the surface area of the top of the actuation piston 441, upon which hydraulic pressure is applied to lock the tappet in its extended configuration. Due to this significantly larger surface area, the stiffness of the lash plenum 437 in the direction of arrow A2 is much larger than the stiffness of the hydraulic control circuit in the direction of arrow A1. Moreover, the stiffness of the lash plenum in the direction of arrow A2 approaches the stiffness of a purely mechanical linkage.

The locking knee tappet 440 provides numerous advantages. For example, the linkage formed by the femur 479 and the shin 439 provides a variable mechanical advantage at the actuation piston 441 with respect to: 1) the force required to initiate extension of the tappet 440 from the retracted configuration and, 2) the force required to hold the tappet 440 in the extended configuration. When in the extended configuration, the majority of the lateral force applied to the tappet 440 by the valve train (in the direction of the arrow A2 in FIGS. 4C and 4D) is directed longitudinally through the knee joint and into the upright portion 467 of the femur support platform 443. Thus, only a small portion of the force exerted by the valve train acts in opposition to the holding force (in the direction of arrow A1) exerted by the hydraulic actuation piston 441. In addition, the large mating surface areas defined by the various hemi-cylindrical socket joints (463, 465, 475, 477, 481, 483) provide a large amount of friction, which resists articulation of the linkage. Thus, the frictional forces assist the hydraulic actuation piston 441 in maintaining the tappet 440 in the extended configuration. Accordingly, the amount of force required to be exerted on the knee by the hydraulic actuation piston 441 to hold the tappet 440 in the extended configuration is relatively small. This permits the use of a small hydraulic actuation piston 441 and a correspondingly small volume of hydraulic fluid, which makes actuation of the hydraulic piston 441 very fast. Since the tappet 440 only needs to be returned to the extended configuration when the bearing element coupled thereto is in contact with the base circle of the cam, relatively little force is required to articulate the knee back to the extended position, and the small hydraulic actuation piston 441 remains adequate.

The locking knee tappet 440 also advantageously provides a hydro-mechanical lost-motion system. Although the tappet 440 is hydraulically actuated (via the hydraulic actuation piston 441 and associated control circuit), the actual locking and longitudinal support of the tappet 440 is provided via a mechanical linkage (the femur 479, the shin 439, etc.). The mechanical nature of the locking function, combined with the very stiff lash plenum 437, provides considerably more stiffness than in a purely hydraulic system. As a result, adequate stiffness can still be achieved with lower mass components, which can be actuated much faster than heavier and bulkier alternatives. The locking knee tappet 440 thus permits fast and consistent actuation of an engine valve.

Figure 5A:
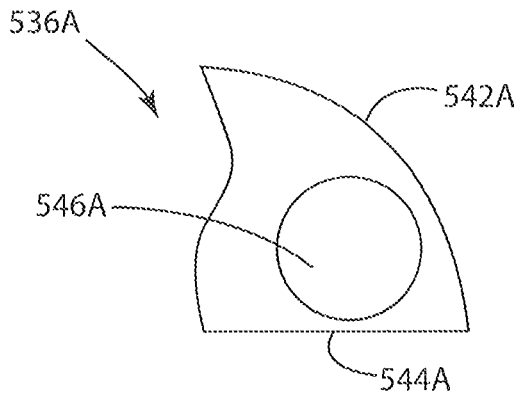
FIG. 5A is a side view of another embodiment of a bearing element according to the present invention.
Figure 5B:
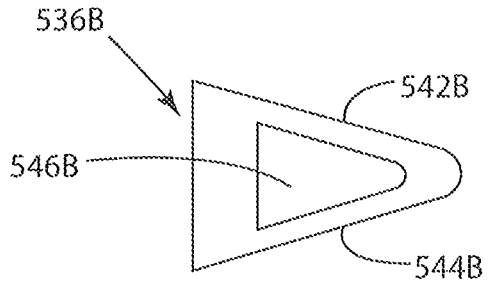
FIG. 5B is a side view of another embodiment of a bearing element according to the present invention.
Figure 5C:
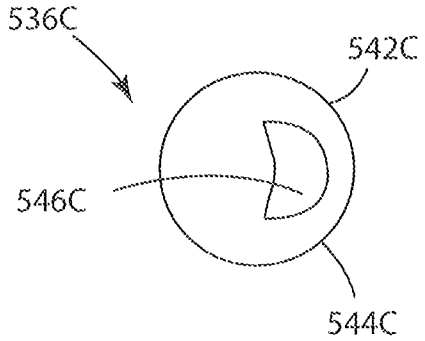
FIG. 5C is a side view of another embodiment of a bearing element according to the present invention.

Although the bearing element 336 of FIGS. 3A-3C is shown as having a generally elliptical-shaped cross-section, the bearing element can have a variety of other cross-sections without departing from the scope of the present invention. FIGS. 5A-5C illustrate various exemplary embodiments of bearing elements.

In FIG. 5A, the bearing element 536A has a quarter-circle or "shark-fin" cross section that forms first and second bearing surfaces 542A, 544A. The bearing element 536A also includes a cavity 546A for reducing a mass thereof.

In FIG. 5B, the bearing element 536B has a wedge-shaped cross section that defines first and second bearing surfaces 542B, 544B. The bearing element 536B also includes at least one cavity 546B.

In FIG. 5C, the bearing element 536C has a circular cross section that defines first and second bearing surfaces 542C, 544C. The bearing element 536C also includes at least one cavity 546C.

Figure 6A:
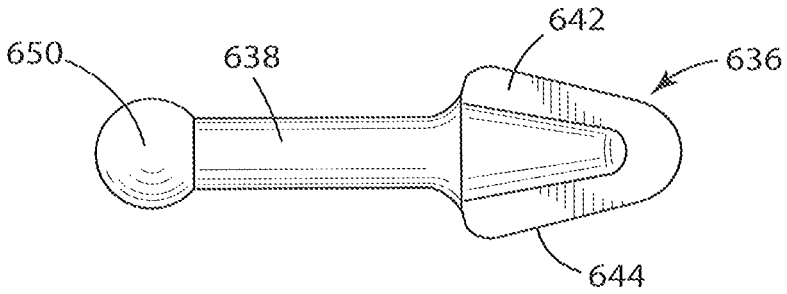
FIG. 6A is a side view of another embodiment of a bearing element according to the present invention.
Figure 6B:
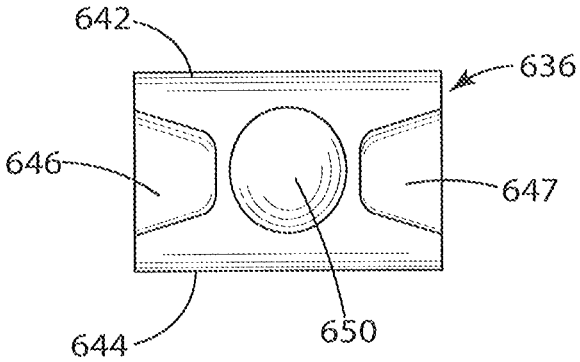
FIG. 6B is an end view of the bearing element of FIG. 6A.
Figure 6C:
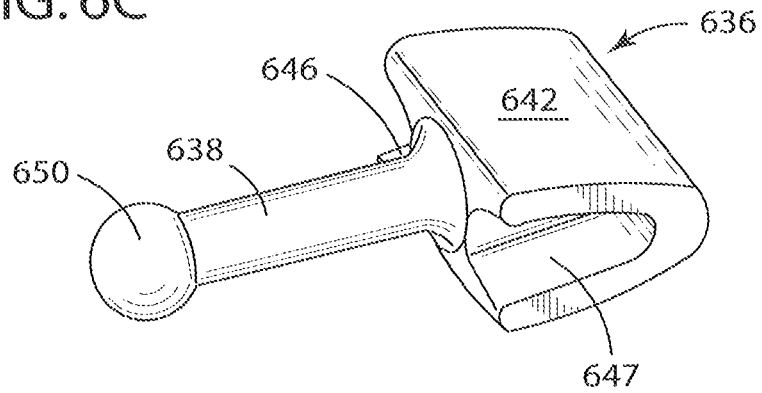
FIG. 6C is a perspective view of the bearing element of FIGS. 6A and 6B.

FIGS. 6A-6C illustrate another exemplary embodiment of a bearing element 636 formed integrally with a connecting arm 638 for use with the valve trains disclosed herein. As shown, the bearing element 636 has a generally wedge-shaped profile defining first and second bearing surfaces 642, 644. First and second cavities 646, 647 are formed on opposing sides of the bearing element 636 defining a connecting arm base portion therebetween. Although not required, the cavities 646, 647 can advantageously reduce the mass of the bearing element 636. The connecting arm 638 is formed integrally with the bearing element 636 and extends from the connecting arm base portion defined by the cavities 646, 647. A spherical ball or cylinder 650, for example for mating with a corresponding socket in an adjustable tappet, is formed on the end of the connecting arm 638.

It will be appreciated that the size, shape, and materials of the bearing elements disclosed herein can be selected to minimize the overall mass of the bearing element and to maximize its structural rigidity.

Figure 7A:
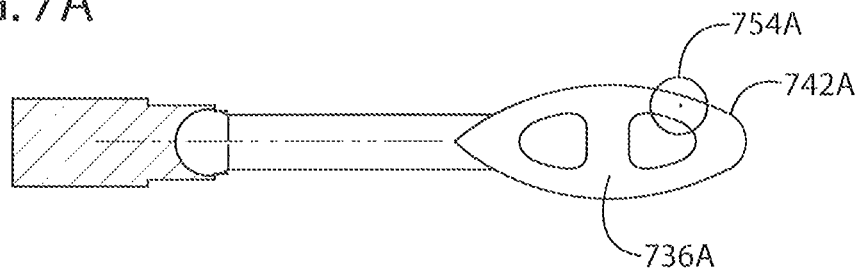
FIG. 7A is a schematic view of one embodiment of an adjustable mechanical element according to the present invention having a roller on a cam engaging surface of a bearing element.

Any of the valve train components disclosed herein can also includes various features for reducing friction between the engagement surfaces thereof. For example, the bearing element can have one or more rollers rotatably mounted thereon, as shown for example in FIGS. 7A-7C. In FIG. 7A, a first, cam-side roller 754A is provided on the first bearing surface 742A of the bearing element 736A for reducing friction between the bearing element 736A and the cam. As the cam rotates in a clockwise direction against the first bearing surface 742A, the roller 754A rotates in a counter-clockwise direction, thus reducing the friction between the bearing element 736A and the cam. Although only one roller 754A is provided in the illustrated embodiment, a plurality of rollers can also be provided on the first bearing surface without departing from the scope of the present invention.

Figure 7B:
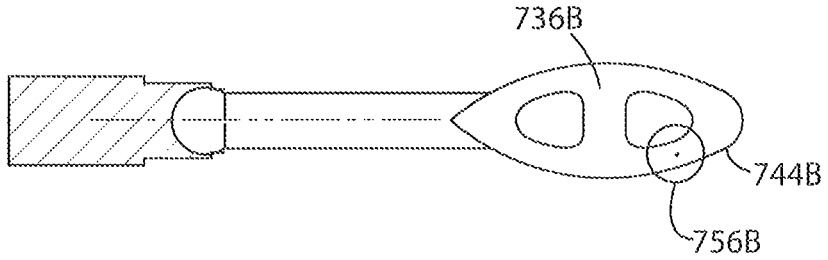
FIG. 7B is a schematic view of another embodiment of an adjustable mechanical element according to the present invention having a roller on a rocker engaging surface of a bearing element.

In FIG. 7B, a second, rocker-side roller 756B is provided on the second bearing surface 744B for reducing friction between the bearing element 736B and the rocker. As the rocker opens the valve and rotates counter-clockwise against the second bearing surface 744B, the roller 756B rotates in a clockwise direction. Similarly, as the rocker closes the valve and rotates clockwise against the second bearing surface 744B, the roller 756B rotates in a counter-clockwise direction. The opposite rotation of the roller 756B reduces the friction between the bearing element 736B and the rocker. Although only one roller 756B is provided in the illustrated embodiment, a plurality of rollers can also be provided on the second bearing surface without departing from the scope of the present invention.

Figure 7C:
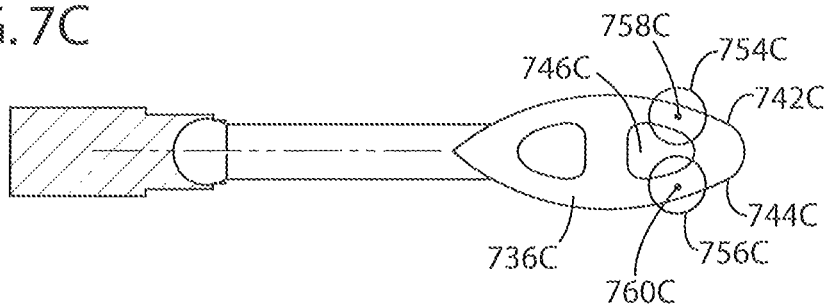
FIG. 7C is a schematic view of another embodiment of an adjustable mechanical element according to the present invention having rollers on both a cam engaging surface and a rocker engaging surface of a bearing element.

In FIG. 7C, two rollers 754C, 756C are provided, one on each of the bearing surfaces 742C, 744C, for reducing friction between the bearing element 736C and both the cam and the rocker. Operation of the rollers 754C, 756C is substantially the same as the operation of the rollers 754A, 756B discussed above. In the illustrated embodiment, the rollers 754C, 756C are rotatably mounted to the bearing element 736C via first and second axles 758C, 760C. The rollers 754C, 756C can be mounted adjacent to a cavity 746C formed in the bearing element 736C. This can allow lubricating fluid picked up by the cam and transferred to the cam-side roller 754C to drip or spray into the cavity 746C. Once inside the cavity 746C, the fluid can be picked up by the rocker-side roller 756C and ultimately supplied to the engagement surfaces of the rocker and the bearing element.

Figure 8:
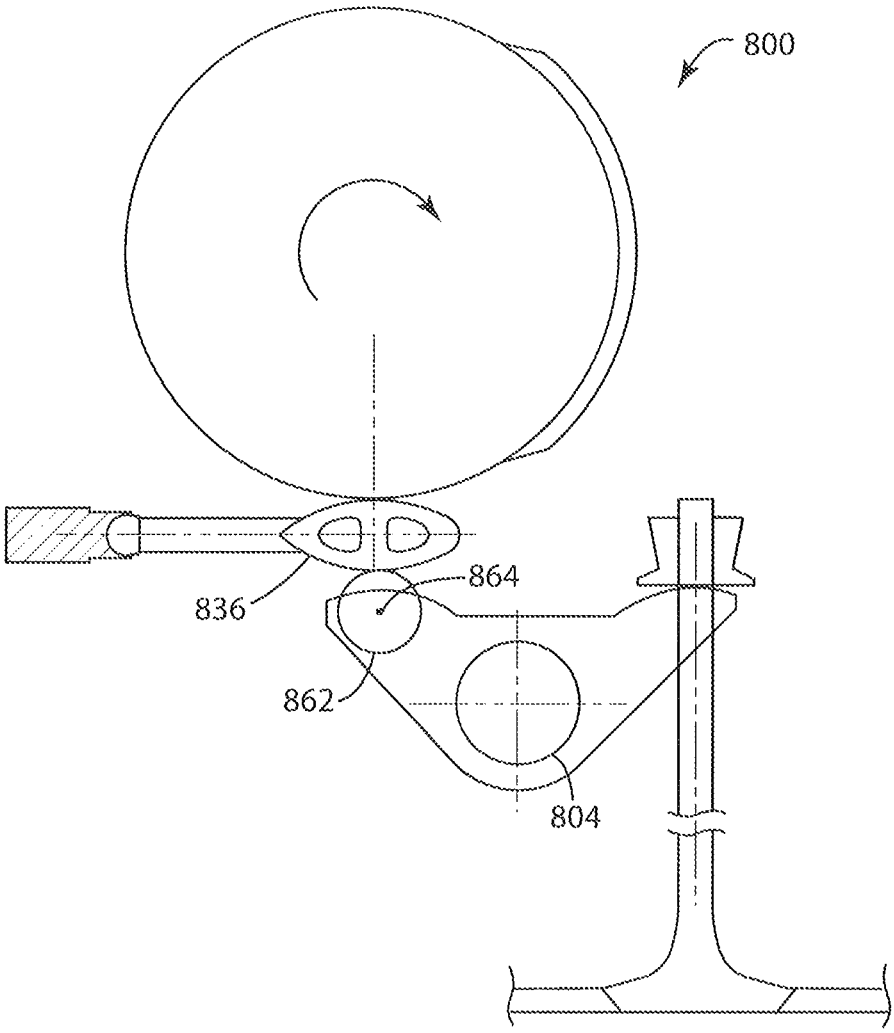
FIG. 8 is a schematic view of one embodiment of a valve train according to the present invention having a rocker with a roller mounted thereon.

In another embodiment, as shown in FIG. 8, the valve train 800 can include a rocker 804 which has a roller 862 of its own, rotatably mounted in place of the rocker pad. The roller 862 is rotatably mounted on an axle 864 and is configured to rotate either clockwise or counterclockwise depending on the motion of the rocker 804. The roller 862 thus reduces friction between the bearing element 836 and the rocker 804.

Other friction reducing features can also be included in any of the valve trains disclosed herein. For example, friction-reducing coatings can be applied to various surfaces of the components thereof. As another example, one or more fluid jackets can be formed in the bearing element for supplying lubricating fluid to the bearing surfaces thereof through one or more openings formed in the bearing surfaces. It will be appreciated that various combinations of the friction-reducing features can be employed as well.

In cam-driven actuation systems, the closing or landing ramp of the cam generally dictates the speed at which the valve contacts its seat when the valve closes. If the valve is closed earlier than what is called for by the cam, however (i.e., by actuating a lost-motion system before the closing ramp reaches the rocker), the valve can undesirably "free-fall" under the stiffness of the valve spring. This can cause the valve to crash against the valve seat, causing damage to the valve, the seat, and/or other components of the valve train. Accordingly, it can be desirable to control the rate at which the valve closes.

In any of the valve trains 300, 800 disclosed above, the shape of the bearing element 336, 836 itself can be used to control the rate at which the valve is allowed to close. In other words, the bearing surfaces of the bearing element can act as a closing ramp, and by controlling the rate at which the bearing element is withdrawn from between the cam and the rocker, the rate at which the valve closes can likewise be controlled.

Figure 9A:
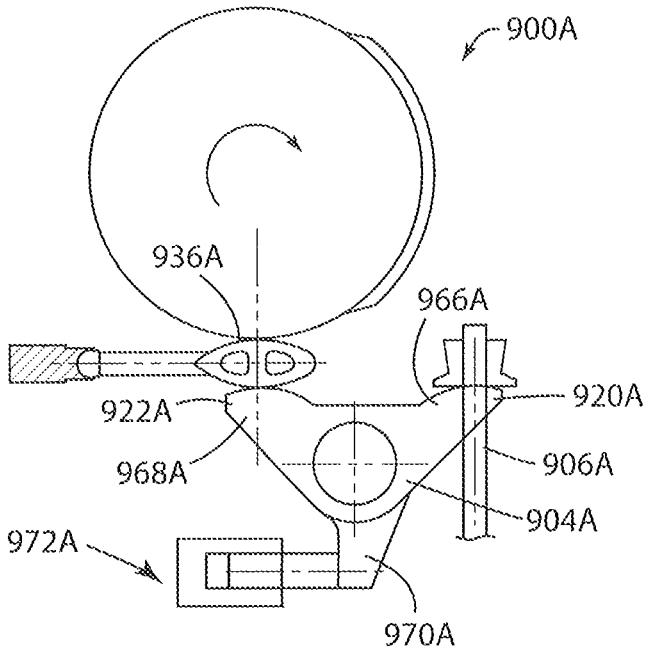
FIG. 9A is a schematic view of another embodiment of a valve train according to the present invention having a valve seating control device.
Figure 9B:
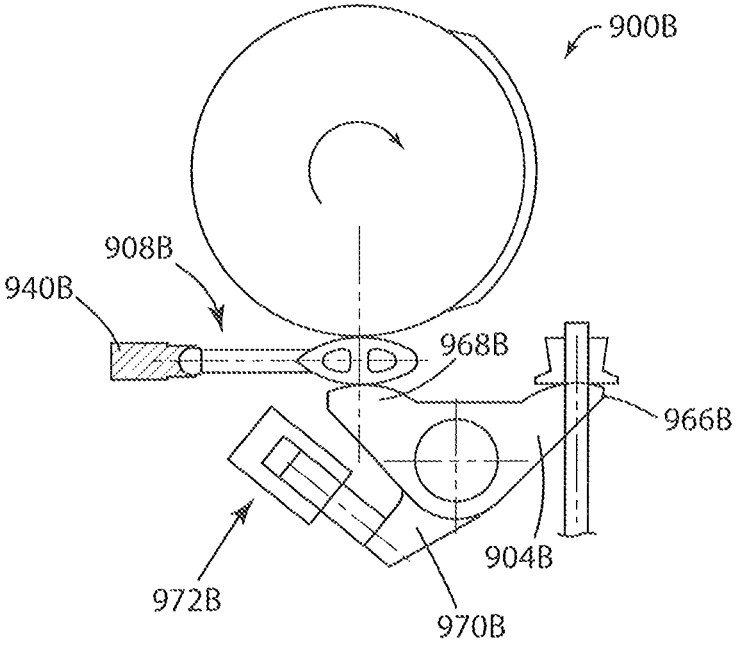
FIG. 9B is a schematic view of another embodiment of a valve train according to the present invention having a valve seating control device.
Figure 9C:
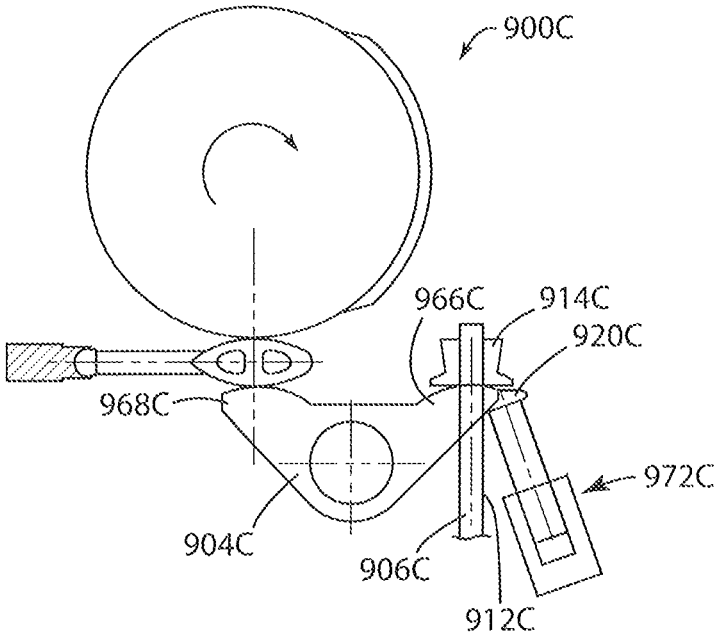
FIG. 9C is a schematic view of another embodiment of a valve train according to the present invention having a valve seating control device.

Alternatively, or in addition, any of the valve trains disclosed herein can include a valve seating control device or "valve catch" to rapidly decelerate the velocity of the valve as it approaches the valve seat when closing. FIGS. 9A-9C illustrate exemplary embodiments of valve trains according to the present invention that include one or more valve seating control devices.

As shown in FIG. 9A, the valve train 900A includes a rocker 904A that generally includes three radial extensions 966A, 968A, 970A. The first extension 966A includes the forked rocker pad 920A for engaging the valve 906A. The second extension 968A includes the rocker pad 922A for engaging the bearing element 936A. The third extension 970A is coupled to a valve seating control device 972A.

In the illustrated embodiment, the valve seating control device 972A is a collapsible hydraulic tappet. The tappet can include a primary orifice that permits fluid to be released relatively freely from a fluid chamber formed within the tappet. The tappet can also include a secondary orifice, smaller than the primary orifice, configured to limit the rate at which fluid is permitted to escape from the fluid chamber. In use, when the valve approaches the valve seat during a closing event, the primary orifice can be closed. Fluid can then only escape from the collapsible tappet through the smaller secondary orifice and thus escapes at a much slower rate. This reduction in the rate at which fluid can escape from the fluid chamber results in a corresponding deceleration of the rocker and thus of the valve.

The primary orifice can be closed in a variety of ways. For example, a high-speed solenoid valve can be actuated to "close" the primary orifice. Alternatively, or in addition, the primary orifice can become occluded as the valve closes by a moving piston or other component of the collapsible tappet. Further details on valve seating control devices can be found in U.S. Patent Publication No. 2010/0180875, entitled "SEATING CONTROL DEVICE FOR A VALVE FOR A SPLIT-CYCLE ENGINE," filed on Jan. 22, 2009, the entire contents of which are hereby incorporated by reference herein.

The various radial extensions of the rocker can be positioned in a variety of angles with respect to each other to attain the clearance and leverage required for successful operation. For example, as shown in FIG. 9B, a valve train 900B includes a rocker 904B in which the third extension 970B is positioned at a slightly different angle with respect to the first and second extensions 966B, 968B and with respect to the rotational axis of the rocker 904B. This geometry can be used for example when additional clearance is needed for the valve stem or the valve head, or when it is desirable to position the valve seating control device 972B adjacent to the tappet 940B of the adjustable mechanical element 908B (i.e., for easier routing or placement of hydraulic lines and/or controls).

FIG. 9C illustrates another embodiment of a valve train 900C in which a valve seating control device 972C engages a rocker 904C having only first and second radial extensions 966C, 968C. In the illustrated embodiment, the forked rocker pad 920C has an increased length such that the opposed fork portions thereof extend past the valve stem 912C and valve adapter assembly 914C of the valve 906C when straddling the valve stem. The valve seating control device 972C engages the underside of the opposed fork portions of the forked rocker pad 920C where the fork portions extend beyond the valve stem 912C. This embodiment of the rocker 904C is desirable when it is necessary to reduce the size and mass of the rocker 904C.

Figure 10A:
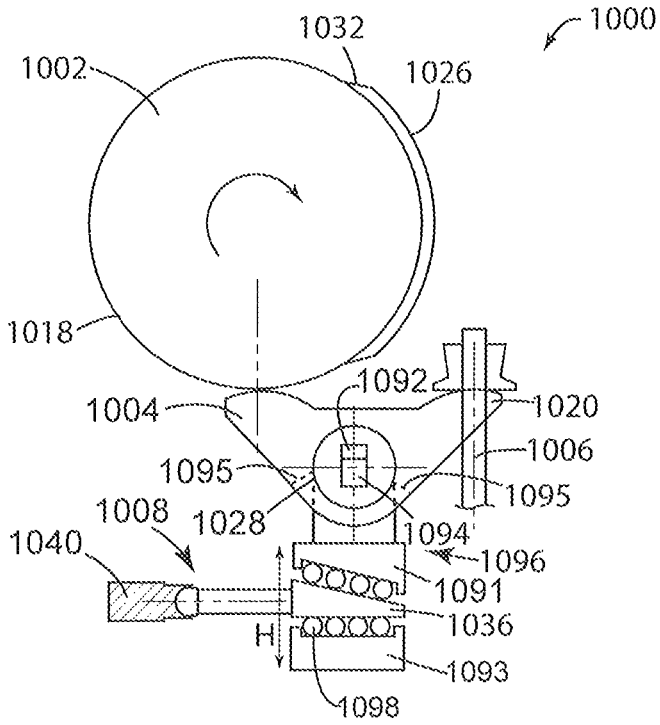
FIG. 10A is a schematic view of one embodiment of a valve train according to the present invention having a collapsible rocker.

In the valve train 300 of FIGS. 3A-3C, the lost-motion function is achieved by one or more elements disposed between the cam and the rocker. This need not always be the case, however. For example, lost-motion can also be achieved by one or more elements disposed between first and second portions of an adjustable pedestal on which the rocker is mounted such that the distance between the cam and the pivot point of the rocker can be adjusted. FIG. 10A illustrates one embodiment of a valve train 1000 having such a configuration. As shown, the valve train 1000 includes a cam 1002, a rocker 1004, a valve 1006, and an adjustable mechanical element 1008 including a bearing element 1036. The rocker 1004 is mounted on a rocker shaft 1028 having a rectangular aperture 1092 formed therein. The aperture 1092 is sized to slidably receive a rectangular projection 1094 disposed on a rigidly fixed rocker support (not shown). The rectangular projection 1094 has a fixed position relative to the cam 1002 and can thus guide the vertical movement of the rocker 1004 and limit the degree to which the pivot point of the rocker 1004 can be adjusted.

The bearing element 1036 is disposed between opposed halves 1091, 1093 of the rocker pedestal 1096 that are movable relative to each other such that sliding movement of the bearing element 1036 is effective to adjust a height H of the pedestal 1096. In the illustrated embodiment, the bearing element 1036 has a wedge-shaped cross-section, although it will be appreciated that a variety of cross-sections can be used without departing from the scope of the present invention. A plurality of roller bearings 1098 can be provided to facilitate sliding movement of the bearing element 1036 relative to the pedestal 1096. Also, in the illustrated embodiment, the upper half 1091 of the rocker pedestal 1096 extends through a slot 1095 in the rocker 1004 to integrally connect to the rocker shaft 1028. The slot 1095 is sized to receive the upper half 1091 of the rocker pedestal 1096 and to allow for pivoted movement of the rocker 1004 during a valve event.

In operation, the cam 1002 rotates clockwise as a camshaft to which it is mounted is driven by rotation of the engine's crankshaft. When the base circle portion 1018 of the cam 1002 engages the rocker 1004, the rocker 1004 remains in a position in which the forked rocker pad 1020 does not apply sufficient lifting force to the valve 1006 to overcome the bias of the valve spring, and therefore the valve 1006 remains closed on its seat.

As the cam 1002 rotates, a dwelled eccentric portion 1026 thereof engages the rocker 1004. The eccentric portion 1026 imparts a downward force to the rocker 1004, causing it to rotate counterclockwise and lift the valve 1006 off of its seat until the eccentric portion 1026 rotates past the rocker 1004 or until a lost-motion function is called for.

An adjustable tappet 1040 is used as described above to partially or fully withdraw the bearing element 1036 from the pedestal 1096 when a lost-motion function is called for (i.e., when it is desired to close the valve 1006 before the closing ramp 1032 of the cam 1002 reaches the rocker 1004 or to reduce the degree to which the valve 1006 is opened). As the bearing element 1036 is withdrawn, the downward force applied to the rocker 1004 by the cam 1002 and by the valve spring causes the upper portion 1091 of the pedestal 1096 and the rocker shaft 1028 attached thereto to move away from the cam 1002. In other words, the pivot point of the rocker 1004 moves downward as the rocker shaft 1028 slides relative to the fixed projection 1094 inserted through the aperture 1092.

When the bearing element 1036 is withdrawn far enough from the pedestal 1096, insufficient motion is imparted from the cam 1002 to the rocker 1004 for the valve 1006 to actually be lifted off of its seat, and thus the valve 1006 closes or remains closed. The valve train 1000 thus provides a lost-motion feature that allows for variable valve actuation (i.e., permits the valve 1006 to close at an earlier time than that provided by the profile of the cam 1002). Furthermore, the valve train 1000 permits the lift of the valve 1006 to be varied, for example by varying the degree to which the bearing element 1036 is withdrawn from or inserted into the pedestal 1096.

It will be appreciated that the angle of the wedge-shaped bearing element 1036 can be adjusted to alter the magnitude of valve train forces that are exerted on the tappet 1040 and/or the amount of tappet stroke required to accomplish the lost-motion. For example, as the angle of the wedge approaches zero, the axial forces on the tappet 1040 decrease but the amount of stroke required for the tappet 1040 increases. Similarly, as the angle of the wedge approaches 90 degrees, the axial forces on the tappet 1040 increase while the amount of stroke required decreases. Higher axial forces require the use of a larger, sturdier tappet. Longer tappet strokes decrease the reaction time of the system, as it takes longer to actuate the tappet. Also, a shorter stroke reduces the effective mass, which results in a higher actuation speed, while a longer stroke increases the effective mass, which results in a slower actuation speed. The wedge shape of the bearing element 1036 permits these parameters to be optimized such that a reasonably-sized tappet can be used without sacrificing too much in the way of response time. The stroke of the tappet 1040 ranges between a lower value equal to the amount of valve lift to be lost and an upper value equal to about 2-3 times the amount of valve lift to be lost. The angle of the wedge ranges between about 0 degrees and about 25 degrees, and preferably is about 20 degrees. The angle of the wedge can also be adjusted based on the ratio of the rocker being used. It will be appreciated that the locking knee tappet 440 disclosed above can also be employed to advance and retract the bearing element 1036.

Figure 10B:
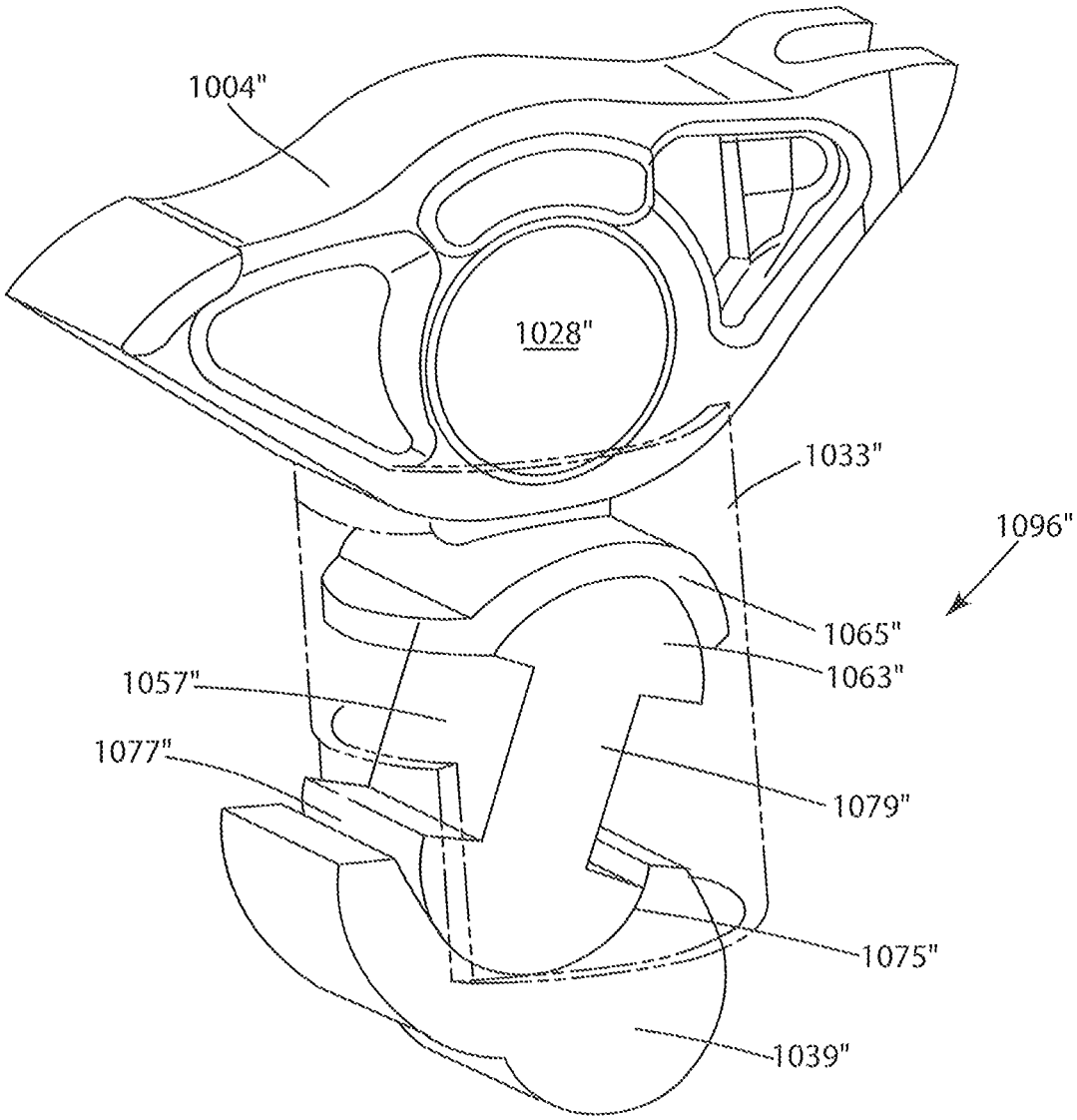
FIG. 10B is a perspective view of another embodiment of a valve train according to the present invention having a locking knee collapsible rocker pedestal.
Figure 10C:
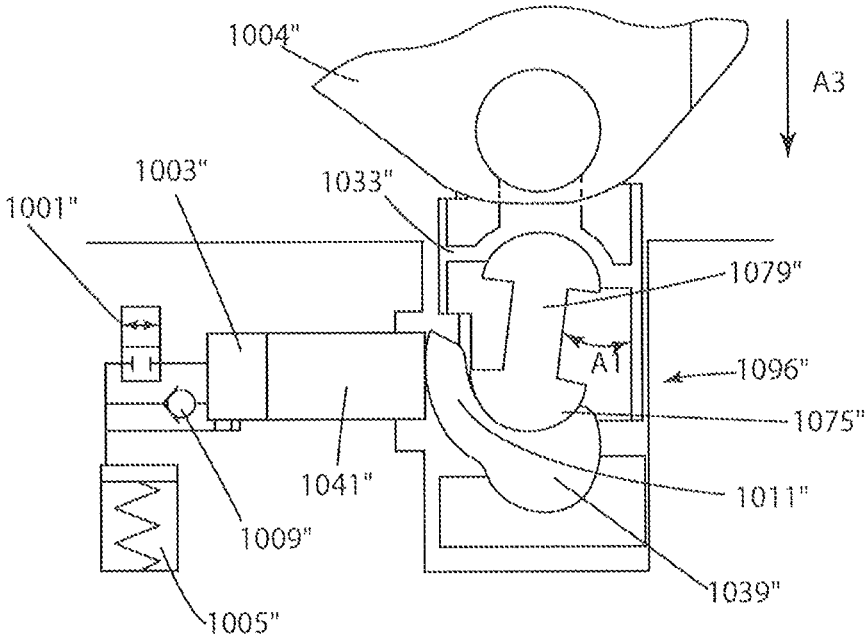
FIG. 10C is a schematic cross-sectional side view of the locking knee collapsible rocker pedestal of FIG. 10B in an extended configuration.
Figure 10D:
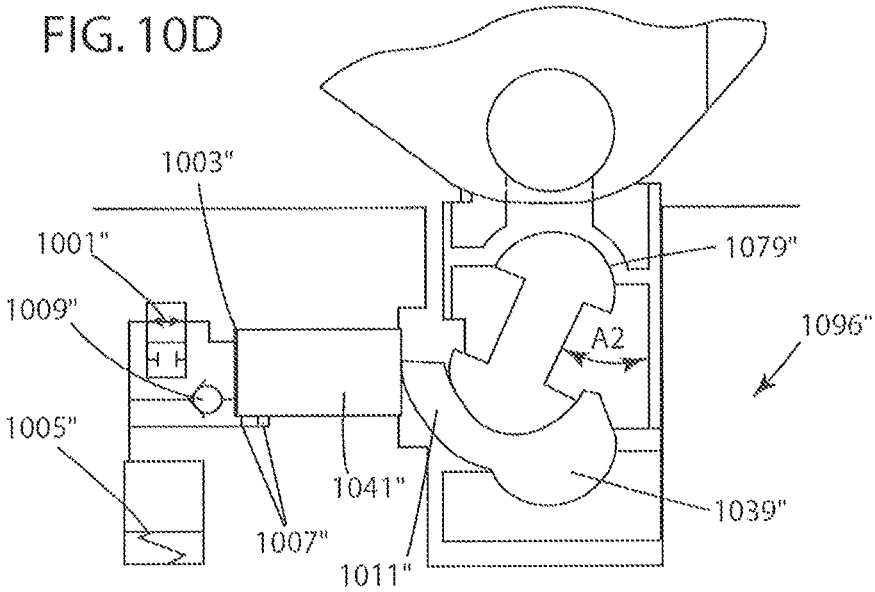
FIG. 10D is a schematic cross-sectional side view of the locking knee collapsible rocker pedestal of FIGS. 10B-10C in a collapsed configuration.

FIGS. 10B-10D illustrate another exemplary mechanism for collapsing the pivot point of a rocker to achieve a lost-motion effect. As shown in FIG. 10B a locking knee collapsible rocker pedestal 1096" is provided that includes a rocker shaft support housing 1033" (shown in phantom) mounted above a knee linkage that includes a femur 1079" and a shin 1039". A rocker 1004" is rotatably mounted about a rocker shaft 1028", which is in turn fixedly mated to the support housing 1033". The support housing 1033" includes a hemi-cylindrical slot 1065" that receives a corresponding first hemi-cylindrical edge 1063" of the femur 1079" such that the femur 1079" is rotatable relative to the support housing 1033". The femur 1079" also includes a reduced-thickness central portion 1057" and a second hemi-cylindrical edge 1077" opposite the first hemi-cylindrical edge 1063". The second hemi-cylindrical edge 1077" is received in a corresponding hemi-cylindrical slot 1075" formed in the shin 1039" such that the femur 1079" and the shin 1039" are rotatable relative to each other.

Operation of the locking knee collapsible rocker pedestal 1096" is substantially similar to the operation of the locking knee tappet 440 described above and shown in FIGS. 4A-4E. In particular, as shown in FIG. 10C, the collapsible rocker pedestal 1096" has a first extended configuration in which the femur 1079" is positioned at a first angle A1 relative to the support housing 1033" that is relatively small (e.g., about 8 degrees). The first angle A1 can be controlled by a femur support platform (not shown), as described above. When a lost-motion effect is required, the pivot height of the rocker 1004" is dropped, thus allowing an engine valve coupled thereto to close earlier than what is called for by the profile of its corresponding cam. This is accomplished by opening a control valve 1001", which allows hydraulic fluid to drain from a cylinder 1003" in which a hydraulic actuation piston 1041" is reciprocally disposed. When the control valve 1001" is opened, downward forces (e.g., in the direction of the arrow A3) exerted on the rocker 1004" by the cam and/or the valve spring cause the collapsible rocker pedestal 1096" to transition to a collapsed configuration, as shown in FIG. 10D. In this configuration, the "knee" formed at the intersection of the femur 1079" and the shin 1039" buckles or articulates, driving the hydraulic actuation piston 1041" into the cylinder 1003" and expelling hydraulic fluid out of the cylinder 1003" and into an accumulator 1005". The cylinder 1003" includes one or more orifices 1007" that are progressively occluded by the hydraulic actuation piston 1041" to achieve a valve catch effect as described above. In the collapsed configuration, the femur 1079" forms a second angle A2 relative to the housing 1033" that is greater than the first angle A1. In one embodiment, the angle A2 can be about 23 degrees.

Once the eccentric portion of the cam has rotated past the rocker, the collapsible rocker pedestal 1096" is transitioned back into the extended configuration. The control valve 1001" is closed and the accumulator 1005" forces hydraulic fluid into the cylinder 1003" through a check valve 1009" and through the orifices 1007" as they become no longer occluded by the hydraulic actuation piston 1041". As the cylinder 1003" refills, the hydraulic actuation piston 1041" forces the femur 1079" and the shin 1039" to articulate or "straighten," thereby extending the collapsible rocker pedestal 1096" and lifting the pivot point of the rocker 1004".

Figure 10E:
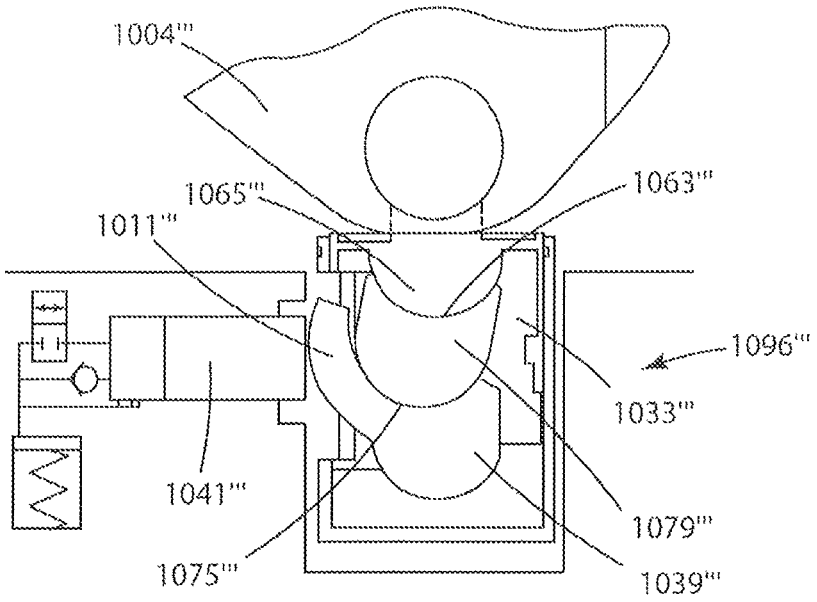
FIG. 10E is a schematic cross-sectional side view of one embodiment of a low profile locking knee collapsible rocker pedestal according to the present invention in an extended configuration.
Figure 10F:
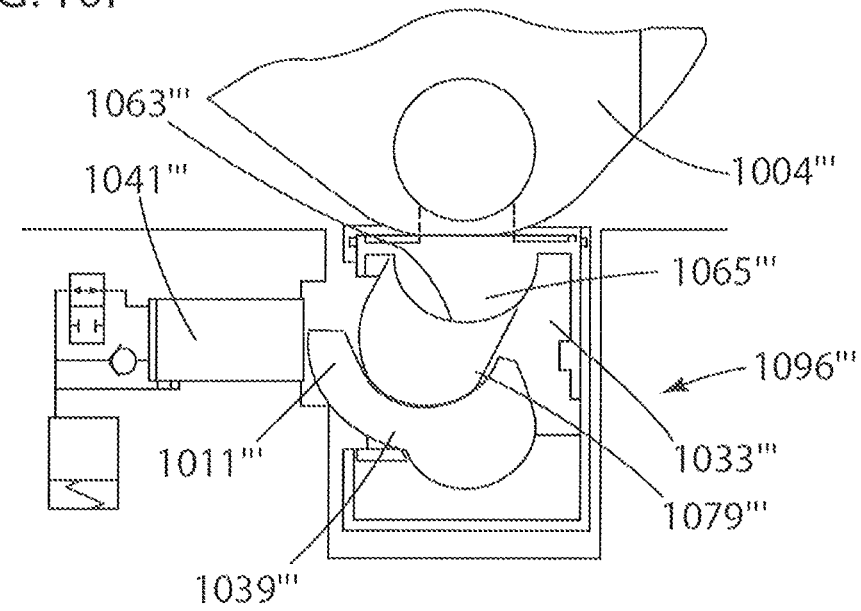
FIG. 10F is a schematic cross-sectional side view of the low profile locking knee collapsible rocker pedestal of FIG. 10E in a collapsed configuration.

FIGS. 10E-10F illustrate an alternative embodiment of a locking knee collapsible rocker 1096'" having a "low profile" in which the support housing 1033'" includes a hemi-cylindrical protrusion 1065'" that is received within a first hemi-cylindrical slot 1063'" formed in the femur 1079'". This embodiment allows for a shorter femur 1079'" to be used and thus reduces the overall profile of the collapsible rocker pedestal 1096'". Operation of this embodiment is substantially similar to the operation of the embodiment shown in FIGS. 10B-10D.

The locking knee collapsible rocker pedestals 1096", 1096'" disclosed herein permit the rocker 1004", 1004'" to be lowered by a distance that is less than the retraction distance of the hydraulic actuation piston 1041", 1041'". For example, in one embodiment the actuation piston has a maximum stroke of 2.4 mm and permits the rocker to be dropped by 1.5 mm. Because the movement distance of the actuation piston is larger than the change in rocker height, the force required to hold the collapsible rocker pedestal in the extended configuration and the force required to transition it into the extended configuration are reduced. As a result, a smaller hydraulic actuation piston/cylinder combination can be used, which allows the valve train to be stiffer, lighter, and faster. Another advantage to this design is that the leading edge 1011", 1011'" of the hemi-cylindrical slot 1075", 1075'" formed in the shin 1039", 1039'" can be used as a lever to obtain a mechanical advantage. For example, the force required to hold the collapsible rocker pedestal in the extended configuration and the force required to transition it into the extended configuration is reduced by lengthening the leading edge 1011", 1011'" and positioning the actuation piston 1041", 1041'" at or close to the terminal end thereof. Again, the lower force requirement permits the use of a smaller, lighter, and faster hydraulic actuator. It will be appreciated that the hydraulic actuation piston 1041", 1041'" in the embodiments of FIGS. 10C-10E can be replaced with the locking knee tappet 440 disclosed above.

The engines and valve trains disclosed herein can also include other features for varying the valve opening and/or closing parameters. In a traditional engine, one or more camshafts rotate at a fixed rate with respect to the crankshaft (i.e., at a rate of two crankshaft rotations for each rotation of the camshaft). The cams in such engines are fixedly mounted to the camshaft, and thus the position of the cams' eccentric portions relative to the crankshaft and pistons (the cam's "phase") is fixed for any given crank angle. Accordingly, there is no way to vary the crank angle at which the opening ramp of the cam first contacts the rocker (or other intermediate valve train element).

Any of the cam-actuated valve trains disclosed herein can also include one or more cam phasers to overcome this limitation. The one or more cam phasers are controlled to adjust the relative position of the eccentric portion of the cam with respect to the crankshaft and pistons. In other words, the cam phaser is used to selectively adjust a phase of the cam relative to the crankshaft and the top dead center (TDC) positions of the compression 110, 210 and expansion 120, 220 pistons.

Figure 11A:
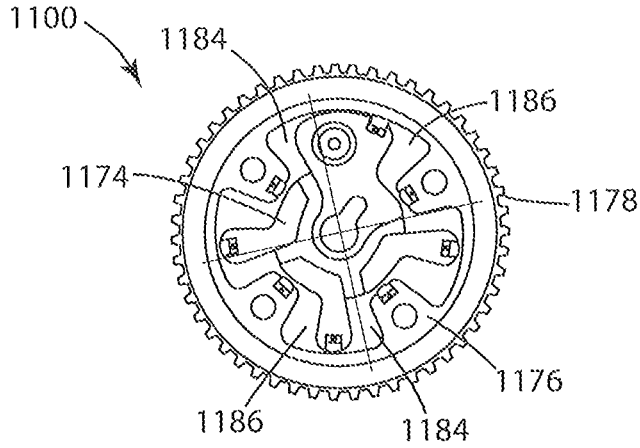
FIG. 11A is a schematic cross-sectional view of one embodiment of a cam phaser according to the present invention.
Figure 11B:
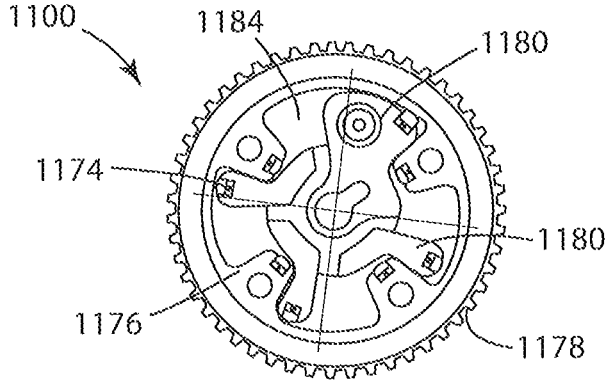
FIG. 11B is a schematic cross-sectional view of the cam phaser of FIG. 11A in an advanced position.
Figure 11C:
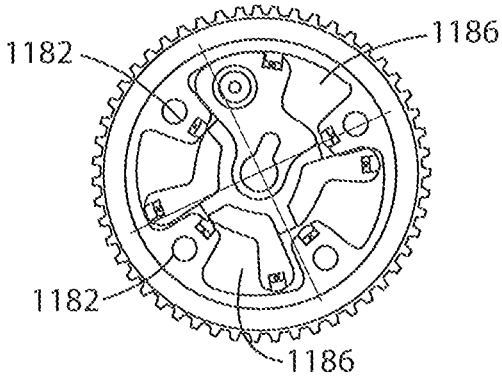
FIG. 11C is a schematic cross-sectional view of the cam phaser of FIGS. 11A and 11B in a retarded position.

FIGS. 11A-11C illustrate one exemplary embodiment of a cam phaser 1100 according to the present invention. As shown, the cam phaser 1100 generally includes a rotor 1174 disposed within a housing 1176. The rotor 1174 is fixedly mated to a camshaft such that the camshaft and rotor 1174 rotate together. A drive sprocket 1178 is formed around or mated to the housing 1176 and is engaged by a timing belt, chain, gear, or the like in order to transfer rotational motion from the crankshaft to the housing 1176 and ultimately to the camshaft.

The rotor 1174 includes a plurality of vanes 1180 that extend radially-outward away from the rotational axis of the rotor 1174. The housing 1176 includes a corresponding plurality of lobes 1182 that extend radially inward towards the rotational axis of the housing 1176. When assembled, the rotor vanes 1180 are interspersed with corresponding housing lobes 1182, thereby defining advance chambers 1184 and retard chambers 1186 on either side of each of the vanes 1180.

As shown in FIG. 11B, a substantially incompressible hydraulic fluid can be supplied to the advance chambers 1184 and/or removed from the retard chambers 1186 to rotate the rotor 1174 clockwise relative to the housing 1176. Since the phase of the rotor 1174 relative to the camshaft is fixed, and since the phase of the housing 1176 relative to the crankshaft is fixed, clockwise rotation of the rotor 1174 relative to the housing 1176 causes the camshaft phase to be advanced relative to the crankshaft and to the TDC position of the expansion piston 120, 220.

Similarly, as shown in FIG. 11C, hydraulic fluid can be supplied to the retard chambers 1186 and/or removed from the advance chambers 1184 to rotate the rotor 1174 counterclockwise relative to the housing 1176. This in turn causes the camshaft phase to be retarded relative to the crankshaft.

The cam phaser can also include a hydraulic control circuit including one or more oil control valves for selectively supplying the oil or other hydraulic fluid to the various chambers of the cam phaser. It will be appreciated that the cam phase can be adjusted continuously along a given range by controlling the degree to which fluid is added or removed to the various chambers. The cam phaser can also include one or more locking mechanisms (e.g., locking pins or springs) that can be engaged to prevent relative rotation of the rotor and the housing, thereby locking the phase of the camshaft relative to the crankshaft.

The orientation of the cam phaser can be opposite to that described above, such that the outer housing is fixedly mated to the camshaft and such that the inner rotor is driven by the crankshaft. A variety of other cam phaser technologies known in the art can also be employed without departing from the scope of the present invention.

In one embodiment, a split-cycle engine (such as the engines 100, 200 discussed above) is provided with a first cam phaser coupled to a first camshaft having a cam disposed thereon for actuating a XovrC valve of the engine. The engine can also include a second cam phaser coupled to a second camshaft having a cam disposed thereon for actuating a XovrE valve of the engine. In this manner, the cam phase for the XovrC valve and XovrE valve can be independently controlled. In one embodiment, the cam phase for the XovrC valve and for the XovrE valve can each be independently advanced or retarded +/−30 degrees CA using the cam phasers. The engine can also include markings on an outer surface of the housing, the camshaft, and/or the crankshaft to facilitate closed-loop feedback control of the cam phasing. For example, one or more sensors can be provided such that a control unit coupled thereto can determine, based on the markings, the actual phase of the camshaft relative to the crankshaft (and pistons) and adjust the phase as desired.

Figure 12A:
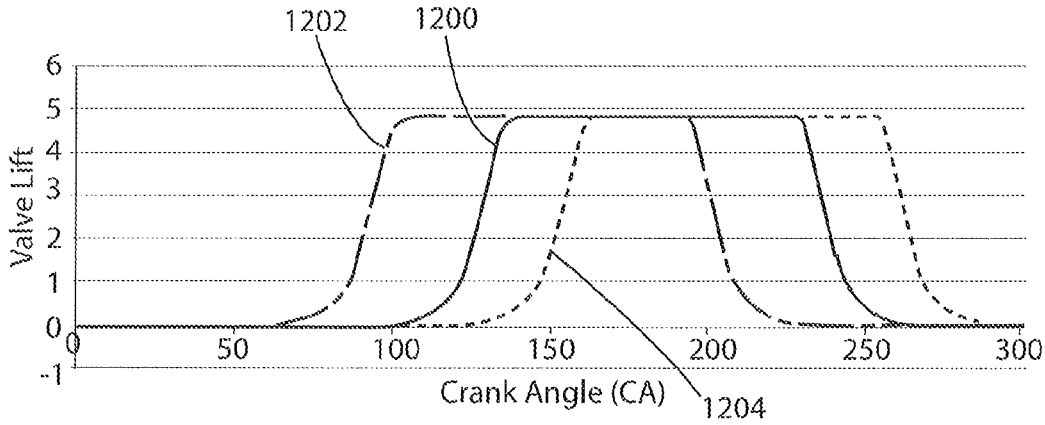
FIG. 12A is a graph of valve lift as a function of crank angle for a valve actuated by one embodiment of a valve train according to the present invention.
Figure 12B:
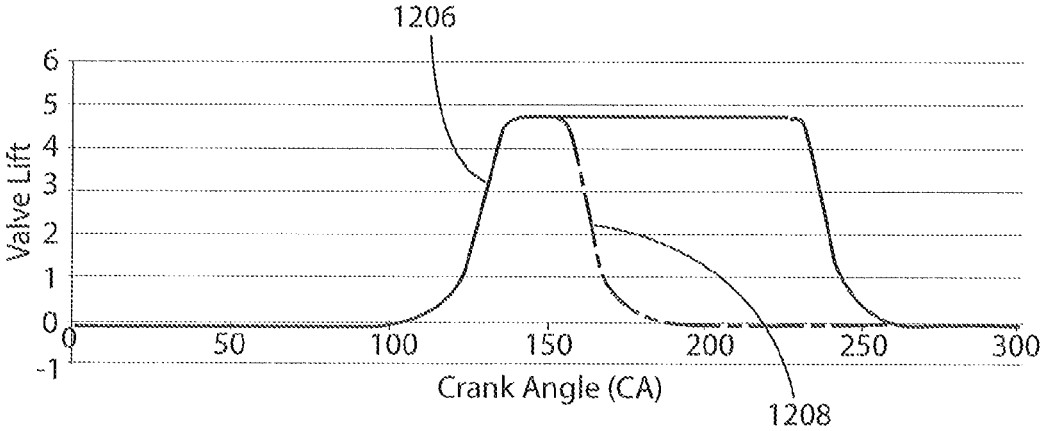
FIG. 12B is a graph of valve lift as a function of crank angle for a valve actuated by one embodiment of a valve train according to the present invention.

FIGS. 12A-12B illustrate the valve lift profile for an engine valve that is variably actuated using methods and devices disclosed herein.

FIG. 12A illustrates three exemplary plots of valve lift as a function of position (position being expressed in terms of crank angle CA relative to TDC of a piston, such as an expansion piston) for a valve in one embodiment of an engine according to the present invention. The first plot 1200 illustrates the valve lift when a dwell cam is used and the cam phaser and variable valve actuation system are either not present or are not actuated. As shown, the valve opens with the opening ramp of the eccentric portion of the cam, remains open at a fixed lift throughout the dwell portion of the cam, and then closes with the closing ramp of the cam's eccentric portion.

The second plot 1202 illustrates the valve lift for the same valve when the cam phaser is actuated to advance the cam phase by approximately 30 degrees CA. As shown, the valve opens and closes approximately 30 degrees CA earlier than in the first plot 1200.

The third plot 1204 illustrates the valve lift for the same valve when the cam phaser is actuated to retard the cam phase by approximately 30 degrees CA. As shown, the valve opens and closes approximately 30 degrees CA later than in the first plot 1200, and approximately 60 degrees CA later than in the second plot 1202.

FIG. 12B illustrates two exemplary plots of valve lift as a function of position (position being expressed in terms of crank angle CA relative to TDC of a piston) for a valve in one embodiment of an engine according to the present invention. The first plot 1206 illustrates the valve lift when a dwell cam is used and the cam phaser and variable valve actuation system are either not present or are not actuated.

The second plot 1208 illustrates the valve lift for the same valve when the variable valve actuation system is actuated to close the valve early. As shown, the valve opens with the opening ramp of the eccentric portion of the cam and remains open at a fixed lift for a fraction of the dwell portion of the cam. When the variable valve actuation system is actuated, in this case at approximately 150 degrees CA, the valve begins to close. This could occur for example when the valve train 300 of FIGS. 3A-3C is used and the bearing element 336 is withdrawn from between the cam 302 and the rocker 304. As shown, the lift profile of the valve's closing event can be controlled in this situation with a valve seating control device as described herein to substantially mimic the closing ramp of the cam.

Figure 13:
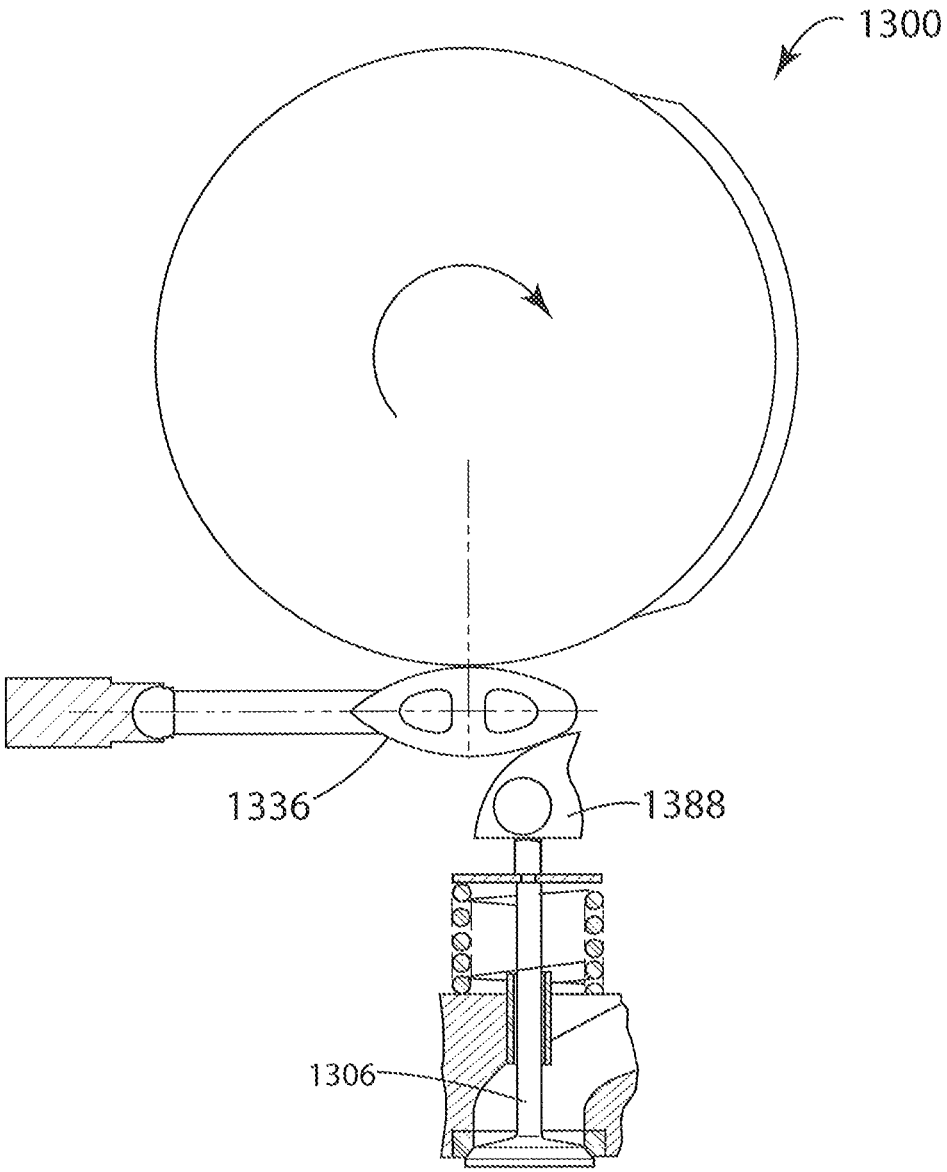
FIG. 13 is a schematic view of one embodiment of a valve train according to the present invention for actuating an inwardly-opening valve.

FIG. 13 illustrates another embodiment of a valve train according to the present invention for use with inwardly-opening engine valves (i.e., engine valves that open into or towards the cylinder). The valve train 1300 is substantially similar to the valve trains 300, 800, 900A, 900B, 900C disclosed herein, and like the valve trains 300, 800, 900A, 900B, 900C can include any combination of the features disclosed herein, except that the rocker is omitted from the valve train 1300 such that the bearing element 1336 is in direct contact with the valve 1306 or contacts the valve 1306 via one or more intermediate elements 1388.

Figure 14:
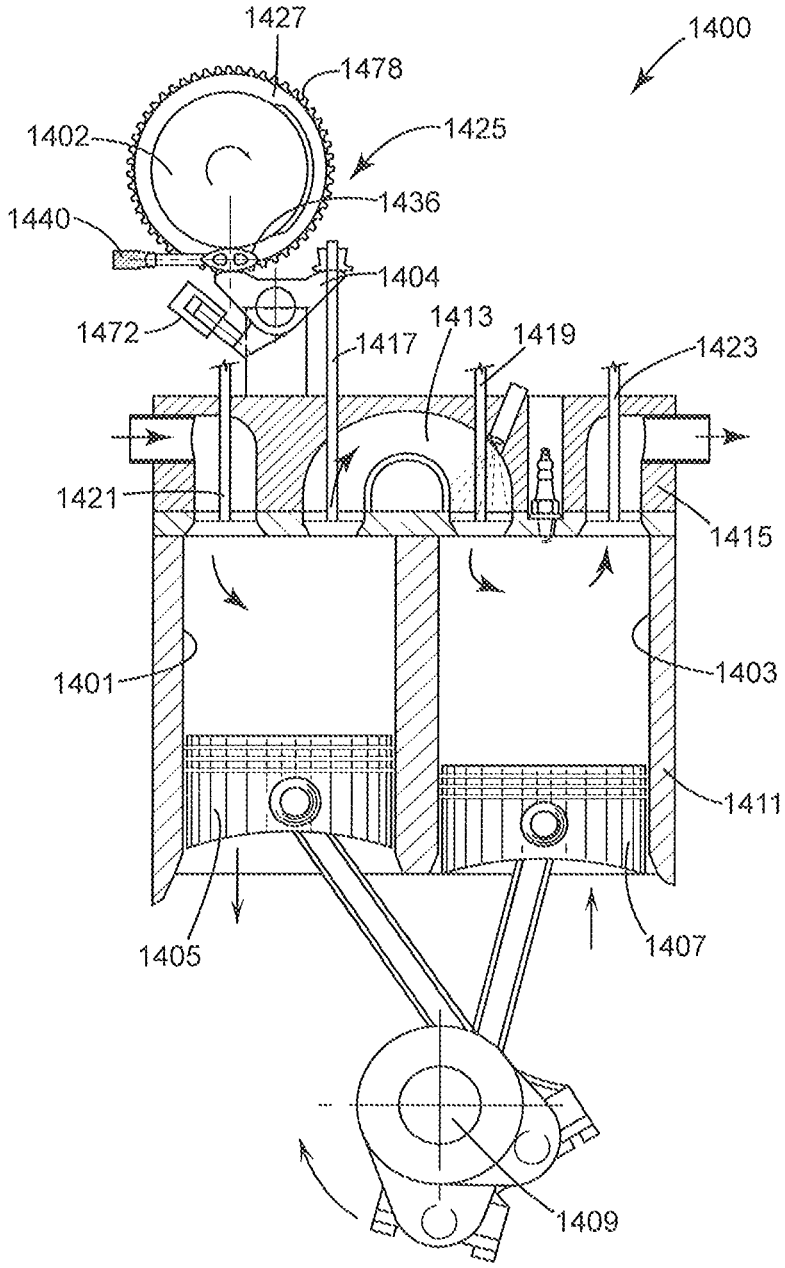
FIG. 14 is a schematic cross-sectional view of one embodiment of a split-cycle engine according to the present invention.

FIG. 14 illustrates one embodiment of a non-hybrid split-cycle engine according to the present invention. As shown, the engine 1400 has a compression cylinder 1401 and an expansion cylinder 1403 in which a compression piston 1405 and an expansion piston 1407 respectively reciprocate. The pistons 1405, 1407 are coupled to a crankshaft 1409 rotatably journaled into an engine block 1411. The compression cylinder 1401 and the expansion cylinder 1403 are joined by at least one crossover passage 1413 formed in a cylinder head 1415. The inlet of the crossover passage 1413 can be selectively opened and closed via an outwardly-opening cam-actuated "XovrC" poppet valve 1417. The outlet of the crossover passage 1413 can be selectively opened and closed via an outwardly-opening cam-actuated "XovrE" poppet valve 1419. In addition, inwardly-opening intake and exhaust valves 1421, 1423 are mounted in the cylinder head 1415. For clarity of illustration, the valve train or valve trains associated with the intake valve 1421, the XovrE valve 1419, and the exhaust valve 1423 are not shown.

The outwardly-opening XovrC valve 1417 can be selectively actuated via a valve train 1425. It will be appreciated that the outwardly-opening XovrE valve 1419 can also be selectively actuated with the same valve train 1425. The valve train 1425 includes a dwell cam 1402 mounted on a camshaft coupled to a cam phaser 1427. A sprocket 1478 of the cam phaser 1427 is driven by a timing belt, chain, and/or gear which is in turn driven by rotation of the crankshaft 1409. As the cam phaser 1427 is driven, the camshaft and dwell cam 1402 mounted thereon rotate clockwise. When the dwell cam 1402 rotates, it imparts motion to a bearing element 1436 which in turn selectively imparts some or all of the cam's motion to a rocker 1404, as described above.

The cam phaser 1427 can be selectively actuated to advance or retard the phase of the cam 1402 relative to the crankshaft 1409. In addition, a hydraulic tappet 1440 coupled to the bearing element 1436 can be selectively actuated to advance the bearing element 1436 towards the cam 1402 and the rocker 1404 or to retract the bearing element 1436 away from the cam 1402 and the rocker 1404. A valve seating control device 1472 is mounted to the cylinder head 1415 and is configured to selectively "catch" (i.e., decrease the velocity of) the XovrC valve 1417 as it closes.

During operation, the opening timing, opening rate, lift, closing timing, closing rate, and various other valve parameters can be controlled. As the crankshaft 1409 rotates, the cam phaser 1427, the camshaft (not shown), and the dwell cam 1402 also rotate as a result of their linkage to the crankshaft via a timing belt, chain, gear, or similar mechanism (not shown). As the dwell cam 1402 rotates, an opening ramp portion thereof contacts the bearing element 1436 which in turn contacts the rocker 1404 and imparts motion thereto (e.g., by causing the rocker 1404 to pivot or rotate counter-clockwise. This in turn causes the valve-engaging end of the rocker 1404 to impart motion to the valve 1417 (e.g., by lifting the valve 1417 upwards from its valve seat) and thereby opens the valve 1417. The timing of this valve opening event can optionally be advanced or retarded by actuating the cam phaser 1427, as described above.

When a dwell portion of the cam 1402 contacts the bearing element 1436, the rocker 1404 can be held in a substantially fixed angular orientation which in turn holds the valve 1417 open at a substantially fixed linear distance from the valve seat. If early valve closing control is called for (e.g., by an engine control unit), pressurized hydraulic fluid maintained in the tappet 1440 is rapidly drained, reducing the length of the tappet 1440 and withdrawing the bearing element 1436 from the cam 1402 and the rocker 1404. As a result, the rocker 1404 pivots or rotates clockwise under the bias of a valve spring (not shown) until the valve 1417 closes against the seat. In this case, the valve seating control device 1472 operates to slow the rotation of the rocker 1404 and thus the velocity of the valve 1417 as the valve 1417 approaches the seat.

Alternatively, when early valve closing control is not called for, the valve 1417 remains open a fixed linear distance until the dwell section of the cam 1402 passes the bearing element 1436 and the bearing element 1436 contacts the closing ramp of the cam 1402. At that time, the bias of the valve spring forcing the valve 1417 closed causes the rocker 1404 to pivot or rotate clockwise until the valve 1417 is closed. The valve closing velocity can be controlled by the closing ramp profile of the cam and/or by a valve seating control device 1472, as explained above.

In the illustrated exemplary embodiment, the opening timing of the crossover valves 1417, 1419 can be independently varied at least plus or minus 30 degrees CA, thus providing at least about a 60 degree CA range over which the opening timing for either valve can be varied. In the same embodiment, the closing timing for either valve can be varied over a range of at least about 100 degrees CA. It will be appreciated that the lost-motion portion of the valve actuation systems disclosed herein permits the closing timing of the valves to be dynamically actuated from one cycle of the engine to the next. In addition, the cam phaser portion of said systems permits the opening timing of the valves to be altered gradually over several cycles of the engine.

The engine 1400 can be readily adapted or modified to include an air hybrid system, as explained above with respect to the engines 100, 200. For example, the crossover passage 1413 can be connected to an air reservoir via a tank port having a tank valve disposed therein. It will thus be appreciated that the illustrated valve train can also advantageously provide the dynamic valve actuation characteristics required for efficient operation of an air hybrid engine.

The engine 1400 is configured to operate reliably over a broad range of engine speeds. In certain embodiments, engines according to the present invention can be capable of operating at a speed of at least about 4000 rpm, and preferably at least about 5000 rpm, and more preferably at least about 7000 rpm.

Figure 15:
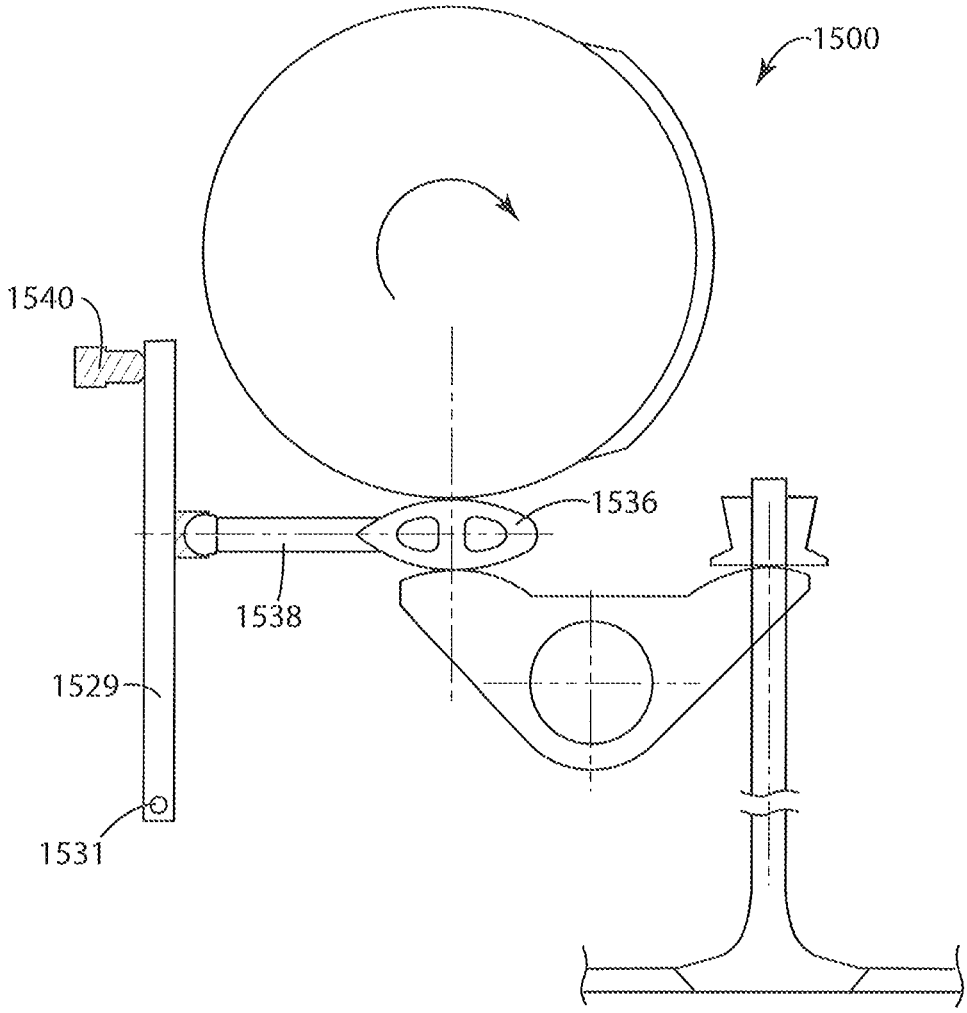
FIG. 15 is a schematic view of one embodiment of a valve train according to the present invention that includes a bell crank.

FIG. 15 illustrates another embodiment of a valve train according to the present invention. The illustrated valve train 1500 is substantially identical to the valve train 300 described above with respect to FIGS. 3A-3C, except that a bell crank 1529 is positioned between the tappet 1540 and the connecting arm 1538 to provide a mechanical advantage (i.e., leverage) when adjusting a position of the bearing element 1536. The bell crank 1529 is rotatably mounted at a pivot point 1531, which has a fixed position. The tappet 1540 is attached to the bell crank 1529 at an end opposite the pivot point. A ball and socket joint is provided at an intermediate point on the bell crank 1529 to couple the bell crank 1529 to the connecting arm 1538. Adjusting the position along the bell crank 1529 at which the connecting arm 1538 is attached adjusts the lever ratio of the bell crank 1529, thereby increasing or decreasing the amount of force required to be supplied by the tappet 1540 and/or the amount of distance that the tappet 1540 must move to effect the desired movement of the bearing element 1536. This embodiment can be particularly useful in systems where a relatively large amount of force is required to advance and/or withdraw the bearing element 1536, since it allows a relatively weak tappet 1540 to perform satisfactorily.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An engine comprising:

a camshaft having a cam formed thereon;

a rocker coupled to an engine valve; and a lost-motion system comprising:

a bearing element having a variable thickness between opposed first and second bearing surfaces, the bearing element being positioned between the cam and the rocker such that the first bearing surface slidably engages the cam and the second bearing surface slidably engages the rocker;

an actuator configured to vary the degree to which the bearing element is inserted between the cam and the rocker to vary the degree to which motion of the cam is imparted to the rocker; and a connecting arm that is rotatably coupled to the actuator and non-rotatably coupled to the bearing element;

wherein the actuator is collapsible along a length thereof to allow the bearing element to be pushed away from the cam and the rocker.

2. The engine of claim 1, wherein the engine is a split-cycle engine.

3. The engine of claim 2, further comprising a crossover passage wherein the engine valve is a crossover valve formed in said crossover passage.

4. The engine of claim 1, wherein the engine is an air hybrid engine.

5. The engine of claim 1, wherein the engine valve is an outwardly-opening valve.

6. The engine of claim 1, further comprising a cam phaser that selectively adjusts a phase of the cam relative to a crankshaft to advance or retard an opening timing of the engine valve.

7. The engine of claim 6, wherein the cam phaser comprises:

a rotor fixedly coupled to the camshaft and having a plurality of vanes extending radially away from a rotational axis of the rotor;

a housing in which the rotor is disposed, the housing including a plurality of lobes extending radially towards a rotational axis of the housing; and a fluid control valve configured to supply hydraulic fluid to two or more fluid chambers formed between the plurality of vanes and the plurality of lobes, wherein supplying hydraulic fluid to a first chamber of the two or more fluid chambers is effective to rotate the rotor in a first direction relative to the housing and supplying hydraulic fluid to a second chamber of the two or more fluid chambers is effective to rotate the rotor in a second direction opposite to said first direction.

8. The engine of claim 6, wherein the lost-motion system is operable to close the engine valve earlier than the engine valve would have closed if closed by a profile of the cam.

9. The engine of claim 1, wherein the bearing element has an elliptical-shaped cross-section.

10. The engine of claim 1, wherein the first and second bearing surfaces are convex bearing surfaces.

11. The engine of claim 1, wherein the bearing element has a wedge-shaped cross-section.

12. The engine of claim 1, wherein the bearing element has a circular cross-section.

13. The engine of claim 1, wherein the actuator comprises an adjustable hydraulic tappet configured to selectively impart bi-directional linear motion to the bearing element.

14. The engine of claim 1, wherein at least one of the first and second bearing surfaces includes a roller rotatably mounted to the bearing element.

15. The engine of claim 1, further comprising a valve seating control device configured to reduce a velocity of the engine valve when the valve approaches a corresponding valve seat after the lost-motion system is actuated.

16. The engine of claim 1, wherein the cam is a dwell cam.

17. The engine of claim 1, wherein the actuator comprises a hydraulic tappet configured to selectively allow the bearing element to be pushed away from the cam and the rocker to close the engine valve earlier than the engine valve would have closed if closed by a profile of the cam.

18. The engine of claim 1, wherein the actuator is collapsible along a length thereof to allow the bearing element to be pushed away from the cam and the rocker by combined forces of the rocker and the cam acting on the bearing element.

19. The engine of claim 1, wherein the actuator is configured either to hold the bearing element in a position where maximum lift is imparted to the valve or to allow the bearing element to be pushed away from the cam and the rocker until no lift is imparted to the valve.

20. A method of actuating an engine valve, comprising:

rotating a cam having an eccentric portion such that the eccentric portion engages a first bearing surface of a bearing element, thereby causing a second bearing surface of the bearing element that is opposed from the first bearing surface to engage a rocker coupled to the engine valve, the bearing element being disposed between the cam and the rocker and having a variable thickness along a length thereof between the opposed first and second bearing surfaces such that the degree to which motion is imparted to the engine valve can be controlled by an actuator configured to vary the degree to which the bearing element is inserted between the cam and the rocker; and adjusting a closing timing at which the engine valve begins to close such that the engine valve closes earlier than what is called for by the cam by collapsing the actuator along a length thereof to allow the bearing element to be pushed away from the cam and the rocker, the actuator being rotatably coupled to a connecting arm which is non-rotatably coupled to the bearing element.

21. The method of claim 20, wherein the engine valve is a component of a split-cycle air hybrid engine.

* * * * *